US006401872B1

(12) United States Patent
Morishita

(10) Patent No.: US 6,401,872 B1
(45) Date of Patent: Jun. 11, 2002

(54) ACTIVE GUIDE SYSTEM FOR ELEVATOR CAGE

(75) Inventor: Mimpei Morishita, Tokyo (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/611,662

(22) Filed: Jul. 6, 2000

(30) Foreign Application Priority Data

Jul. 6, 1999 (JP) ..... 11-192081

(51) Int. Cl.[7] ..... B66B 1/34; B66B 7/02

(52) U.S. Cl. ..... 187/292; 187/393; 187/394; 187/409

(58) Field of Search ..... 187/292, 391–394, 187/409, 410

(56) References Cited

U.S. PATENT DOCUMENTS 4,838,172 A 6/1989 Morishita et al.
5,086,882 A * 2/1992 Sugahara et al. ..... 187/410
5,151,562 A * 9/1992 Fujita et al. ..... 187/394
5,477,788 A 12/1995 Morishita
5,905,351 A 5/1999 Morishita
6,079,521 A * 6/2000 Schönauer et al. ..... 187/393
6,128,116 A * 10/2000 Dobler et al. ..... 187/391 X

FOREIGN PATENT DOCUMENTS

JP 63-087482 4/1988

* cited by examiner

*Primary Examiner*—Stanley J. Witkowski
(74) *Attorney, Agent, or Firm*—Oblon, Spivak, McClelland, Maier & Neustadt, P.C.

(57) ABSTRACT

A guide system for an elevator, including a movable unit configured to move, such as,ascend and descend, along a guide rail, a beam projector configured to form an optical path of a light parallel to a moving direction of the movable unit, a position detector disposed on the optical path and configured to detect a position relationship between the optical path and the movable unit, and an actuator coupled to the movable unit and configured to change a position of the movable unit by a reaction force caused by a force operating on the guide rail on the basis of the output of the position detector.

15 Claims, 14 Drawing Sheets

ACTIVE GUIDE SYSTEM FOR ELEVATOR CAGE

CROSS REFERENCE TO RELATED APPLICATION

This application claims benefit of priority to Japanese Patent Application No. 11-192081 filed Jul. 6, 1999, the entire content of which is incorporated by reference herein.

BACKGROUND OF THE INVENTION

1. Field of the Invention

This invention relates to an active guide system guiding a movable unit such as an elevator cage.

2. Description of the Background

In general, an elevator cage is hung by wire cables and is driven by a hoisting machine along guide rails vertically fixed in a hoistway. The elevator cage may shake due to load imbalance or passenger motion, since the cage is hung by wire cables. The shake is restrained by guiding the elevator cage along guide rails.

Guide systems that include wheels rolling on guide rails and suspensions, are usually used for guiding the elevator cage along the guide rails. However, unwanted noise and vibration caused by irregularities in the rail such as warps and joints, are transferred to passengers in the cage via the wheels, spoiling the comfortable ride.

In order to resolve the above problem, various alternative approaches have been proposed, which are disclosed in Japanese patent publication (Kokai) No. 51-116548, Japanese patent publication (Kokai) No. 6-336383, and Japanese patent publication (Kokai) No. 63-87482. These references disclose an elevator cage provided with electromagnets operating attractive forces on guide rails made of iron, whereby the cage may be guided without contact with the guide rails.

Japanese patent publication (Kokai) No. 63-87482 discloses a guide system capable of restraining the shake of the elevator cage caused by irregularities of the guide rails by controlling electromagnets so as to keep a constant distance from a vertical reference wire disposed to be adjacent to the guide rail, thereby providing a comfortable ride, and reducing a cost of the system by getting rid of an excessive requirement of accuracy for an installation of the guide rails.

However, in the present guide system for elevators as described above, there are some following problems.

The vertical reference wire may be easily set up in case of low-rise buildings having a relatively short length hoistway for an elevator, while it is difficult to fix the vertical reference wire in a hoistway so as to be adjacent to guide rails in case of high-rise buildings or super high-rise buildings recently built and appeared. Further, after fixing the vertical reference wire, the vertical reference wire itself often loses its linearity because of a deformation by an aged deterioration of buildings or an influence of thermal expansion. Therefore, it causes a problem that a lot of time and cost is needed for maintaining the fixed vertical reference wire. Furthermore, electromagnets may not be excited in advance against irregularities on the guide rails, since a vertical position of the cage cannot be detected by using the vertical reference wire. Accordingly, a vibration restraining control may not start to run until a position relationship with the vertical reference wire goes wrong due to the irregularities. As a result, a certain extent of shaking may not be restrained in view of the principle. Therefore, there is a limit to improving a comfortable ride in this system.

SUMMARY OF THE INVENTION

Accordingly, one object of this invention is to provide a guide system for an elevator, which improves a comfortable ride by effectively restraining the shake of an elevator cage.

Another object of the present invention is to provide a minimized and simplified guide system for an elevator.

The present invention provides a guide system for an elevator, including a movable unit configured to move along a guide rail, a beam projector configured to form an optical path of a light parallel to a moving direction of the movable unit, a position detector disposed on the optical path and configured to detect a position relationship between the optical path and the movable unit, and an actuator coupled to the movable unit and configured to change a position of the movable unit by a reaction force, caused by a force operating on the guide rail on the basis of the output of the position detector.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 12(*b*) is a front view showing a position detector of a third embodiment;

FIG. 13(*b*) is a front view showing a position detector of a fourth embodiment.

DETAILED DESCRIPTION OF THE PREFERRED EMBODIMENT

Figure 1:
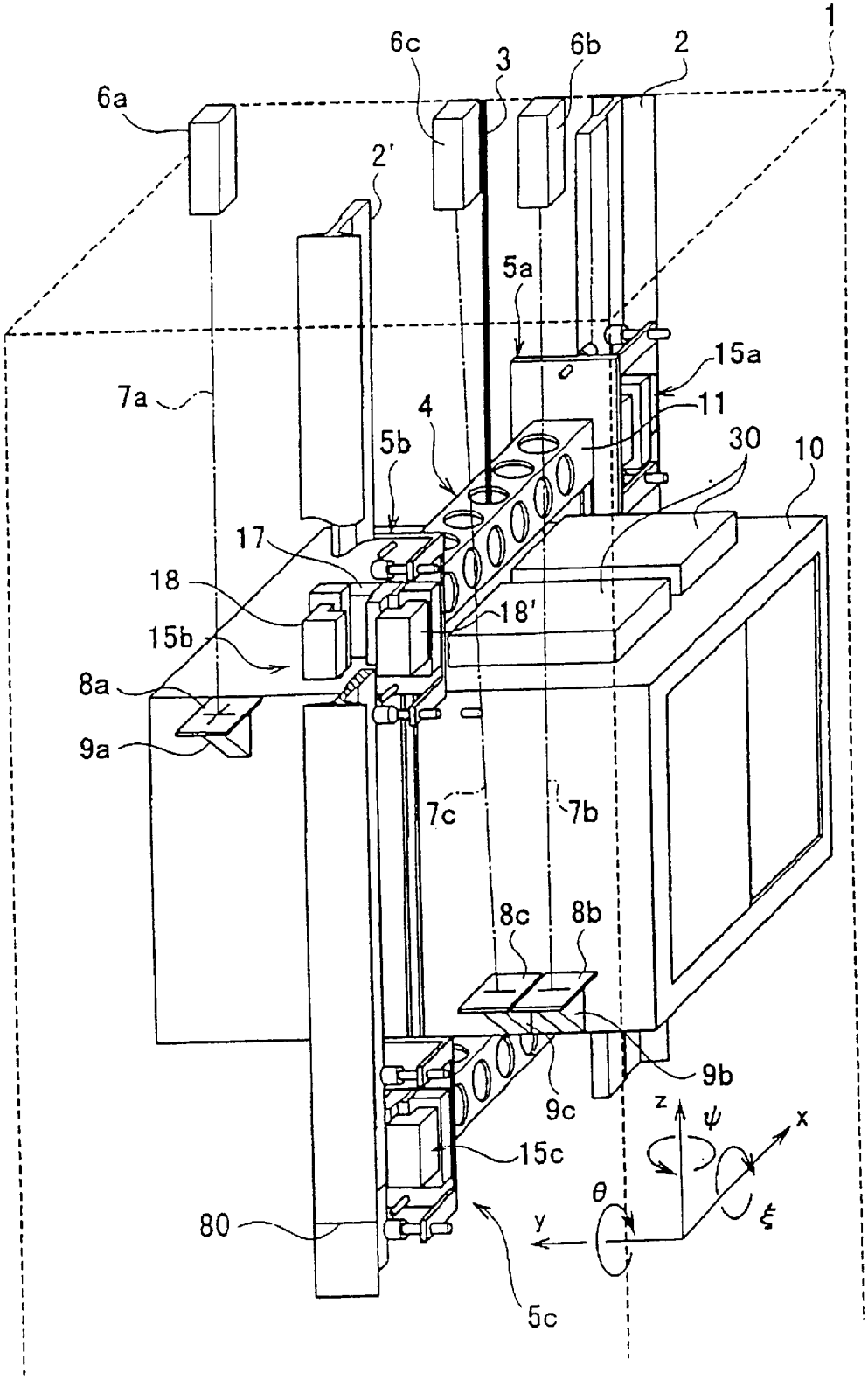
FIG. 1 is a perspective view of a guide system for an elevator cage of a first embodiment of the present invention.
Figure 2:
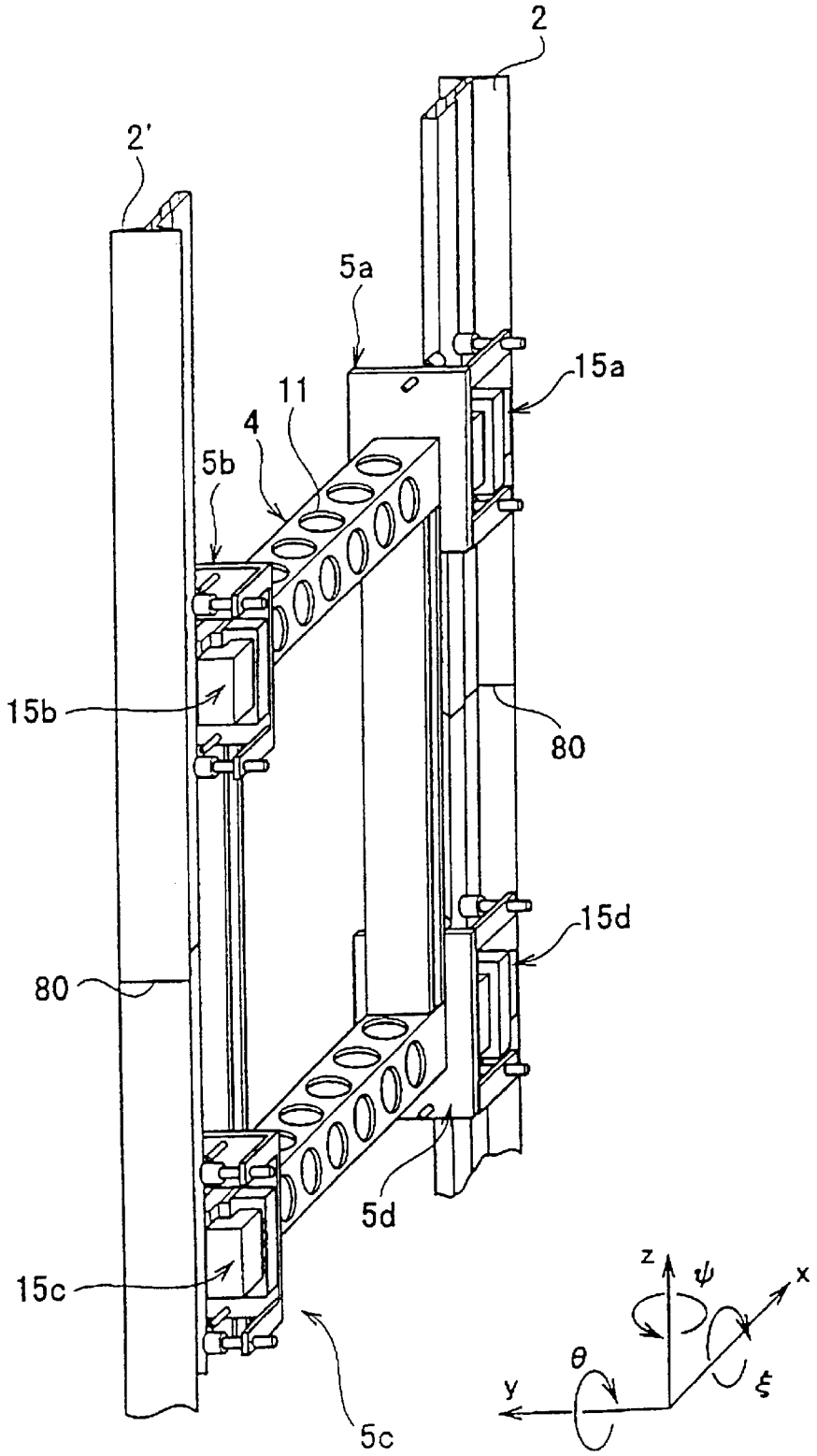
FIG. 2 is a perspective view showing a relationship between a movable unit and guide rails.

Referring now to the drawings, wherein like reference numerals designate identical or corresponding parts throughout the several views, the embodiments of the present invention are described below.

The present invention is hereinafter described in detail by way of illustrative embodiments.

FIGS. 1 through 4 show a guide system for an elevator cage of a first embodiment of the present invention. As shown in FIG. 1, guide rails 2 and 2' made of ferromagnetic substance are disposed on the inside of a hoistway 1 by a conventional installation method. A movable unit 4 ascends and descends along the guide rails 2 and 2' by using a conventional hoisting method (not shown), for example, winding wire cables 3. The movable unit 4 includes four guide units 5*a*, 5*b*, 5*c*, 5*d* attached to the upper and lower corners thereof for guiding the movable unit 4 without contact with the guide rails 2 and 2'.

Laser radiators 6*a*, 6*b* and 6*c*, which are fixed on the ceiling of the hoistway 1, radiate lasers parallel to the guide rails 2 and 2' respectively, and form optical paths 7*a*, 7*b* and 7*c* in the hoistway 1. The laser radiators 6*a*, 6*b* and 6*c* may be, for example, laser oscillating tubes or a laser emitting semiconductor devices.

Two two-dimensional photodiodes 8*a* and 8*b* are attached at different vertical positions on the side of the movable unit 4 as position detectors. Further, a one-dimensional photodiode 8*c* is attached adjacent to the photodiode 8*b* at the same vertical level as the photodiode 8*d*. These photodiodes 8*a*, 8*b* and 8*c* are disposed in the optical paths 7*a*, 7*b* and 7*c*, respectively. The two-dimensional photodiodes 8*a* and 8*b* detect positions of the respective optical paths 7*a* and 7*b* in two-dimensions (x and y directions in FIG. 1). The one-dimensional photodiode 8*c* detects a position of the optical path 7*c* in one-dimension i(y direction in FIG. 1).

The optical paths 7*a* and 7*b* by the laser radiators 6*a* and 6*b* are formed in a verticals direction, and received on the two-dimensional photodiodes 8*a* and 8*b* fixed at different vertical positions relative to each other. Positions of the movable unit 4 with respect to the following five modes of motions of the movable unit 4 are detected on the basis of respective receiving positions of the optical paths 7*a* and 7*b* by a calculation described below.

I. y-mode(back and forth motion mode) representing a right and left motion along a y-coordinate on a center of the movable unit 4

II. x-mode(right and left motion mode) representing a right and left motion along a x-coordinate III. θ-mode(roll mode) representing a rolling about the center of the movable unit 4

IV. ξ-mode(pitch mode) representing a pitching about the center of the movable unit 4

V. ψ-mode(yaw-mode) representing a yawing about the center of the movable unit 4

The laser radiator 6*c* forms the optical path 7*c* tilting slightly so that a receiving spot on a receiving plane of the photodiode 8*c* shifts in the y direction shown in FIG. 1 as the movable unit 4 moves from the lowest position to the highest position in the hoistway 1. Since the photodiode 8*b* and the photodiode 8*c* are disposed at the same level and close to each other, a vertical position of the movable unit 4 in the hoistway is accurately detected by subtracting a value of an optical axis position on the photodiode 8*b* in the y-direction from a value of an Optical axis position on the photodiode 8*c* in the y-direction, even if a position of the movable unit 4 is changed.

The movable unit 4 includes an elevator cage 10 having supports 9*a*, 9*b* and 9*c* on the side surface thereof for the respective photodiodes 8*a*, 8*b* and 8*c*, and guide units 5*a*–5*d*. The guide units 5*a*–5*d* include a frame 11 having sufficient strength to maintain respective positions of the guide units 5*a*–5*d*.

Figure 3:
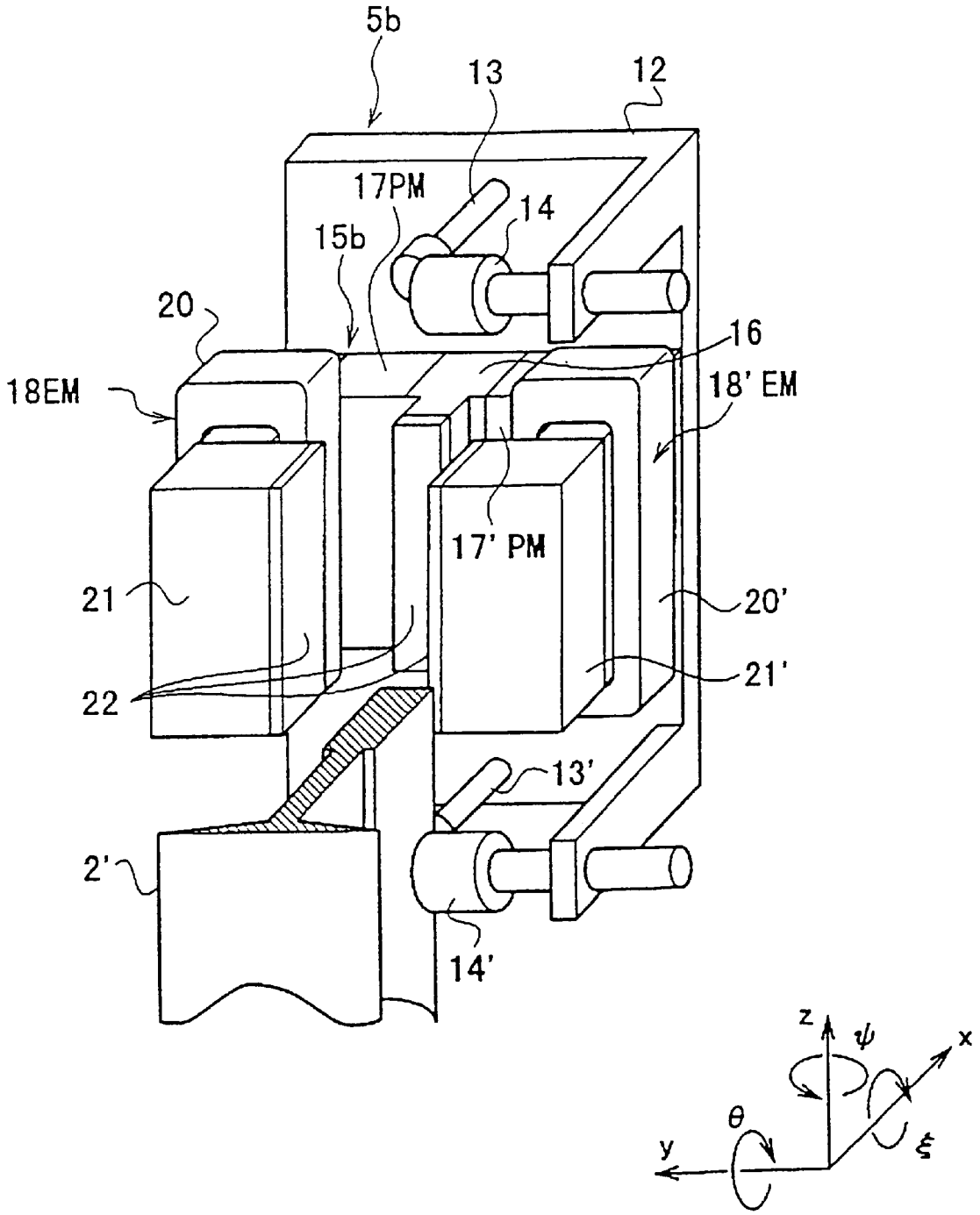
FIG. 3 is a perspective view showing a structure of a guide unit of the guide system.
Figure 4:
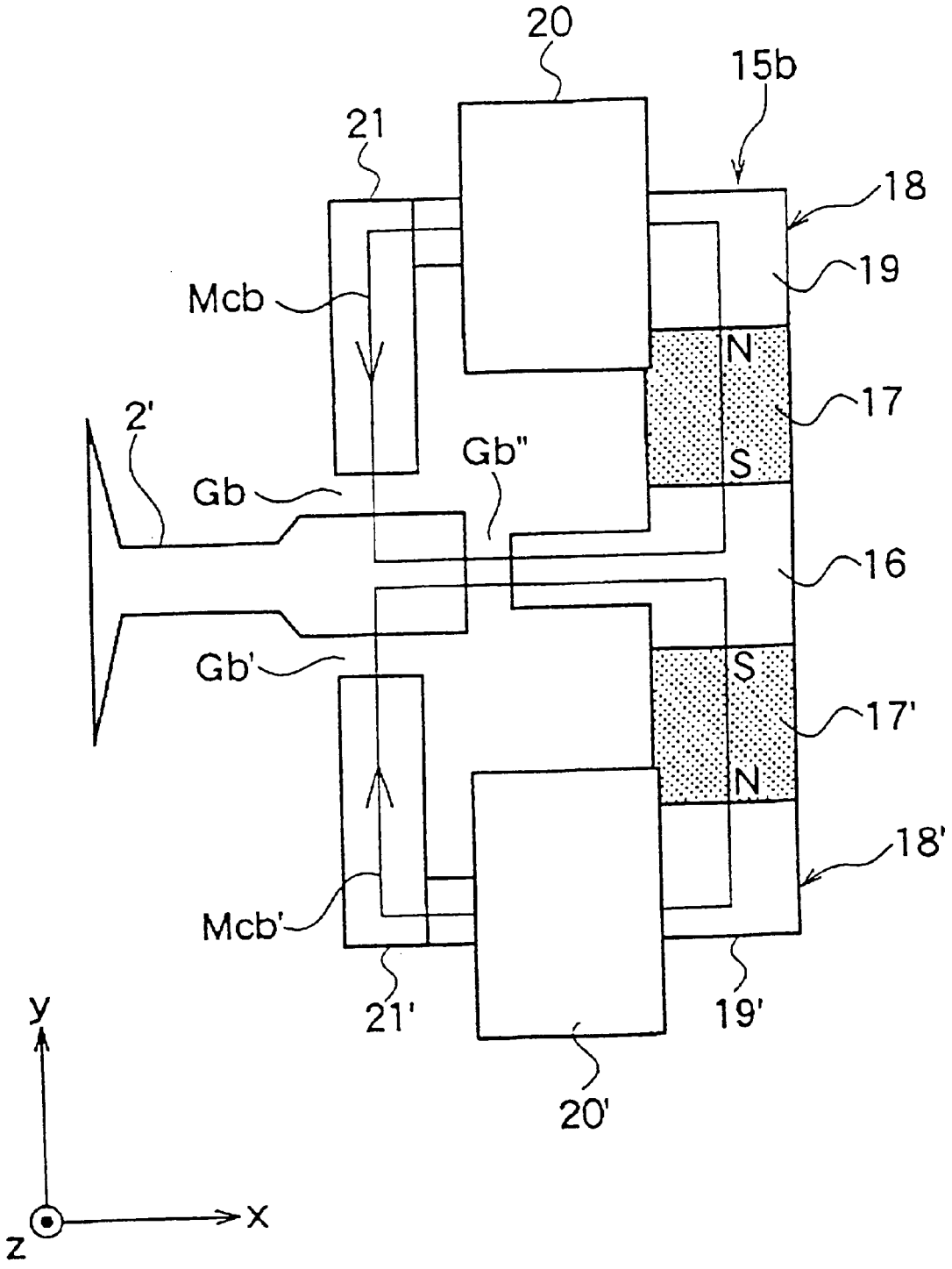
FIG. 4 is a plan view showing magnetic circuits of the guide unit.

The guide units 5*a*–5*d* are respectively attached at the upper and lower corners of the frame 11 and face toward the guide rails 2 and 2', respectively. As illustrated in detail in FIGS. 3 and 4, each of the guide units 5*a*–5*d* includes a base 12 made of non-magnetic substance such as Aluminum, Stainless Steel or Plastic, an x-direction gap sensor 13, a y-direction gap sensor 14, and a magnet unit 15*b*. In FIGS. 3 and 4, only one guide unit 5*b* is illustrated, and other guide units 5*a*, 5*c* and 5*d* are the same structure as guide unit 5*b*. A suffix "b" represents components of the guide unit 5*b*.

The magnet unit 15*b* comprises a center core 16, permanent magnets 17 and 17', and electromagnets 18 and 18'. The same poles of the permanent magnets 17 and 17' are facing each other putting the center core between the permanent magnets 17 and 17', thereby forming an E-shape as a whole. The electromagnet 18 comprises an L-shaped core 19, a coil 20 wound on the core 19, and a core plate 21 attached to the top of the core 19. Likewise, the electromagnet 18' comprises an L-shaped core 19', a coil 20' wound on the core 19', and a core plate 21' attached to the top of the core 19'. As illustrated in detail in FIG. 3, solid lubricating materials 22 are disposed on the top portions of the center core 16 and the electromagnets 18 and 18' so that the magnet unit 15*d* does not adsorb to the guide rail 2' due to an attractive force caused by the permanent magnets 17 and 17', when the electromagnets 18 and 18' are not excited. For example, a material containing Teflon, black lead or molybdenum disulfide may be used for the solid lubricating materials 22.

Figure 5:
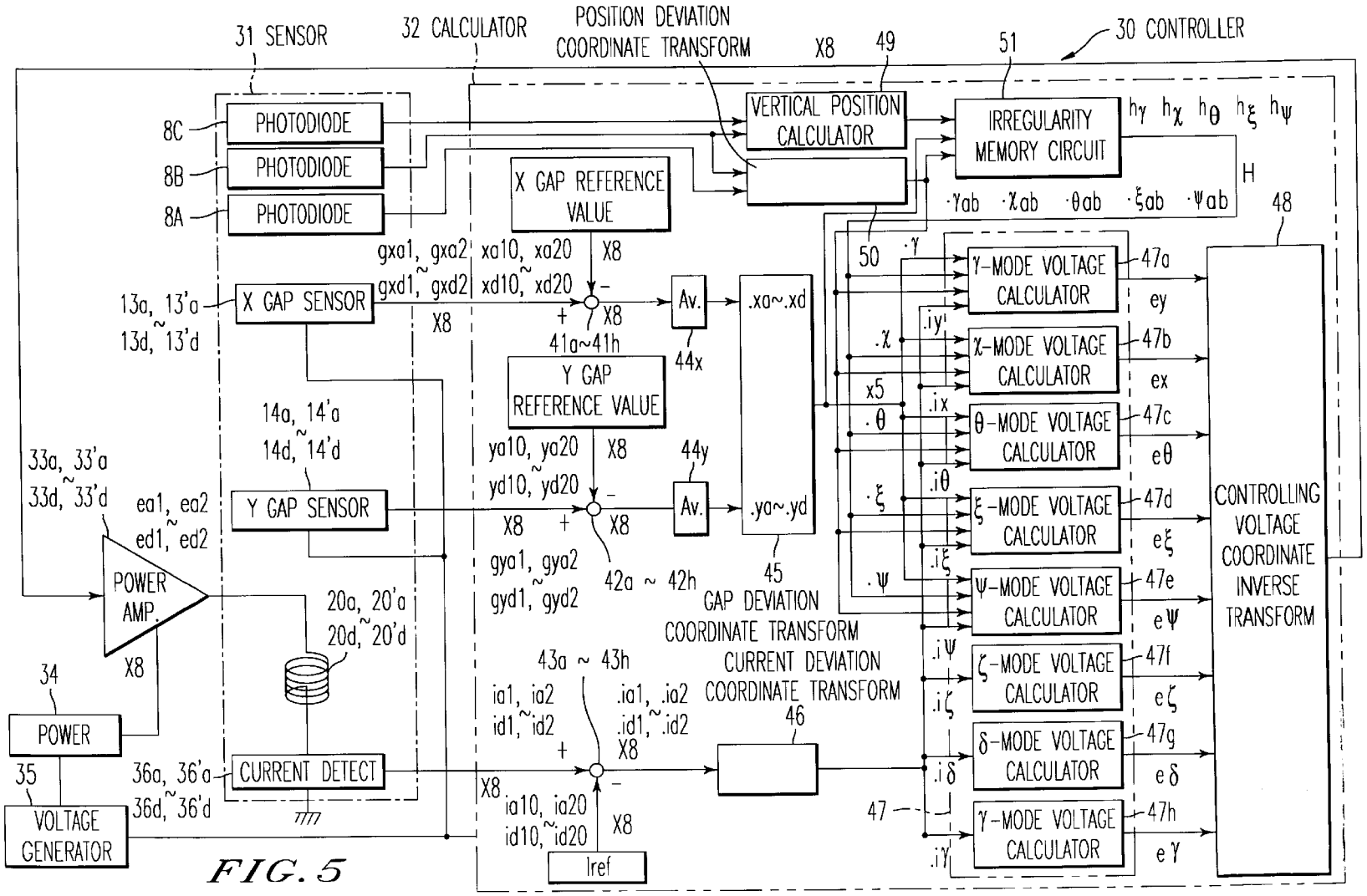
FIG. 5 is a block diagram showing a circuit of a controller.

Each attractive force of the above-described guide units 5*a*–5*d* is controlled by a controller 30 shown in FIG. 5, whereby the cage 10 and the frame 11 are guided with no contact with the guide rails 2 and 2'.

The controller 30 is divided as shown in FIG. 1, but is functionally combined as a whole as shown in FIG. 5. The following is an explanation of the controller 30. In FIG. 5, arrows represent signal paths, and solid lines represent electric power lines around the coils 20*a*, 20'*a*–20*d*, 20'*d*. In the following description, to simplify an explanation of the illustrated embodiment, suffixes "a"–"d" are respectively added to figures indicating the main components of the respective guide units 5*a*–5*d* in order to distinguish them.

The controller 30, which is attached on the elevator cage 4, comprises a sensor 31 detecting variations in magnetomotive forces or magnetic reluctances of magnetic circuits formed with the magnet units 15*a*–15*d*, or in a movement of the movable unit 4, a calculator 32 calculating voltages operating on the coils 20*a*, 20'*a*–20*d*, 20'*d* on the basis of signals from the sensor 31 in order for the movable unit 4 to be guided with no contact with the guide rails 2 and 2', power amplifiers 33*a*, 33'*a*–33*d*, 33'*d* supplying an electric power to the coils 20*a*, 20'*a*–20*d*, 20'*d* on the basis of an output of the calculator 32, whereby attractive forces in the x and y directions of the magnet units 15*a*–15*d* are individually controlled.

A power supply 34 supplies an electric power to the power amplifiers 33*a*, 33'*a*–33*d*, 33'*d* and also supplies an electric power to a constant voltage generator 35 supplying an electric power having a constant voltage to the calculator 32, the x-direction gap sensors 13*a*, 13'*a*–13*d*, 13'*d* and the y-direction gap sensors 14*a*, 14'*a*–14*d*, 14'*d*. The power supply 34 transforms an alternating current power, which is supplied from the outside of the hoistway 1 with a power line(not shown) for lighting or opening and closing doors, into an appropriate direct current power in order to supply the direct current power to the power amplifiers 33*a*, 33'*a*–33*d*, 33'*d*.

The constant voltage generator 35 supplies an electric power with a constant voltage to the calculator 32 and the gap sensors 13 and 14, even if a voltage of the power supply 34 varies due to an excessive current supply, whereby the calculator 32 and the gap sensors 13 and 14 may normally operate.

The sensor 31 comprises the x-direction gap sensors 13*a*, 13'*a*–13*d*, 13'*d*, the y-direction gap sensors 14*a*, 14'*a*–14*d*, 14'*d*, the photodiodes 8*a*, 8*b* and 8*c*, and current detectors 36*a*, 36'*a*–36*d*, 36'*d* detecting current values of the coils 20*a*, 20'*a*–20*d*, 20'*d*.

The calculator 32 controls, magnetic guide controls for the movable unit 4 in every motion coordinate system shown in FIG. 1. The motion coordinate system includes a y-mode (back and forth motion mode) representing a right and left motion along a y-coordinate on a center of the movable unit 4, an x-mode(right and left motion model) representing a right and left motion along a x-coordinate, a θ-mode(roll mode) representing a rolling about the center of the movable unit 4, a ξ-mode(pitch mode) representing a pitching about the center of the movable unit 4, a ψ-mode(yaw-mode) representing a yawing about the center of the movable unit 4. In addition to the above modes, the calculator 32 also controls every attractive force of the magnet units 15*a*–15*d* operating on the guide rails, a torsion torque around the y-coordinate caused by the magnet units 15*a*–15*d*, operating on the frame 11, and a torque straining the frame 11 symmetrically, caused by rolling torques that a pair of magnet units 15*a* and 15*d*, and a pair of magnet units 15*b* and 15*c* operate on the frame 11. In brief, the calculator 32 additionally controls a ζmode (attractive mode), a δ-mode (torsion mode) and a γ-mode (strain mode). Accordingly, the, calculator 32 controls in a way that exciting currents of coils 20 converge zero in the above-described eight modes, which is a so-called zero power control, in order to keep the movable unit 4 steady by only attractive forces of the permanent magnets 17 and 17' irrespective of a weight of a load.

This control method is disclosed in detail in Japanese Patent Publication(Kokai) No. 6-178409, the subject matter of which is incorporated herein by reference. A guide control of this embodiment is executed on the basis of the position data of the optical paths 7*a*, 7*b* and 7*c*. The following describes the guide control executed in this embodiment.

To simplify the explanation, it is assumed that a center of the movable unit 4 is on a vertical line crossing a diagonal intersection point of the center points of the magnet units 15*a*–15*d* disposed on four corners of the movable unit 4. The center is regarded as the origin of respective x, y and z coordinate axes. If a motion equation in every mode of magnetic levitation control system with respect to a motion of the movable unit 4, and voltage equations of exciting voltages applying to the electromagnets 18 and 18' of the magnet units 15*a* 15*d* are linearized around a steady point, the following formulas 1 through 5 are obtained.

Formula 1 is as follows:

$$\begin{cases} M\Delta y''_{ab} = 4\dfrac{\partial F_{ya}}{\partial y_a}\Delta y + 4\dfrac{\partial F_{ya}}{\partial i_{al}}\Delta i_y + U_y \\ (L_{x0} - M_{x0})\Delta i'_y = -N\dfrac{\partial \Phi_{bl}}{\partial y_a}\Delta y' - R\Delta i_y + e_y \end{cases}$$

$$\Delta y = \frac{\Delta y_a + \Delta y_b + \Delta y_c + \Delta y_d}{4}$$

$$\Delta i_y = \frac{\Delta i_{ya} + \Delta i_{yb} + \Delta i_{yc} + \Delta i_{yd}}{4}$$

$$e_y = \frac{\Delta e_{ya} + \Delta e_{yb} + \Delta e_{yc} + \Delta e_{yd}}{4}$$

Formula 2 is a follows:

$$\begin{cases} M\Delta x''_{ab} = 4\dfrac{\partial F_{xb}}{\partial x_b}\Delta x + 4\dfrac{\partial F_{xb}}{\partial i_{bl}}\Delta i_x + U_x \\ (L_{x0} + M_{x0})\Delta i'_x = -N\dfrac{\partial \Phi_{bl}}{\partial x_b}\Delta x' - R\Delta i_x + e_x \end{cases}$$

$$\Delta x = \frac{-\Delta x_a + \Delta x_b + \Delta x_c - \Delta x_d}{4}$$

$$\Delta i_x = \frac{-\Delta i_{xa} + \Delta i_{xb} + \Delta i_{xc} - \Delta i_{xd}}{4}$$

$$e_x = \frac{-\Delta e_{xa} + \Delta e_{xb} + \Delta e_{xc} - \Delta e_{xd}}{4}$$

Formula 3 is as follows:

$$\begin{cases} I_\theta\Delta\theta''_{ab} = l_\theta^2\dfrac{\partial F_{xb}}{\partial x_b}\Delta\theta + l_\theta^2\dfrac{\partial F_{xb}}{\partial i_{bl}}\Delta i_\theta + T_\theta \\ (L_{x0} + M_{x0})\Delta i'_\theta = -N\dfrac{\partial \Phi_{bl}}{\partial x_b}\Delta\theta' - R\Delta i_\theta + e_\theta \end{cases}$$

$$\Delta\theta = \frac{-\Delta x_a + \Delta x_b - \Delta x_c + \Delta x_d}{2l_\theta}$$

$$\Delta i_\theta = \frac{-\Delta i_{xa} + \Delta i_{xb} - \Delta i_{xc} + \Delta i_{xd}}{2l_\theta}$$

$$e_\theta = \frac{-\Delta e_{xa} + \Delta e_{xb} - \Delta e_{xc} + \Delta e_{xd}}{2l_\theta}$$

Formula 4 is as follows:

$$\begin{cases} I_\xi\Delta\xi''_{ab} = l_\theta^2\dfrac{\partial F_{yb}}{\partial y_b}\Delta\xi + l_\theta^2\dfrac{\partial F_{yb}}{\partial i_{bl}}\Delta i_\xi + T_\xi \\ (L_{x0} + M_{x0})\Delta i'_\xi = -N\dfrac{\partial \Phi_{bl}}{\partial y_b}\Delta\xi' - R\Delta i_\xi + e_\xi \end{cases}$$

$$\Delta\xi = \frac{-\Delta y_a - \Delta y_b + \Delta y_c + \Delta y_d}{2l_\theta}$$

$$\Delta i_\xi = \frac{-\Delta i_{ya} - \Delta i_{yb} + \Delta i_{yc} + \Delta i_{yd}}{2l_\theta}$$

$$e_\xi = \frac{-\Delta e_{ya} - \Delta e_{yb} + \Delta e_{yc} + \Delta e_{yd}}{2l_\theta}$$

Formula 5 is as follows:

$$\begin{cases} I_\theta\Delta\psi''_{ab} = l_\psi^2\dfrac{\partial F_{yb}}{\partial y_b}\Delta\psi + l_\psi^2\dfrac{\partial F_{yb}}{\partial i_{bl}}\Delta i_\psi + T_\psi \\ (L_{x0} + M_{x0})\Delta i'_\psi = -N\dfrac{\partial \Phi_{bl}}{\partial y_b}\Delta\psi' - R\Delta i_\psi + e_\psi \end{cases}$$

$$\Delta\psi = \frac{\Delta y_a - \Delta y_b - \Delta y_c + \Delta y_d}{2l_\psi}$$

$$\Delta i_\psi = \frac{\Delta i_{ya} - \Delta i_{yb} - \Delta i_{yc} + \Delta i_{yd}}{2l_\psi}$$

$$e_\psi = \frac{\Delta e_{ya} - \Delta e_{yb} - \Delta e_{yc} + \Delta e_{yd}}{2l_\psi}$$

With respect to the above formulas, $\Phi_b$ is a flux, M is a weight of the movable unit 4, $I_\Theta$, $I_\xi$ and $I_\psi$ are moments of inertia around respective y, x and z coordinates, $U_y$ and $U_x$ are the sum of external forces in the respective y-mode and x-mode, $T_\Theta$, $T_\xi$ and $T_\psi$ are the sum of disturbance torques in the respective θ-mode, ξ-mode and ψ-mode, a symbol "'" represents a first time differentiation d/dt, a symbol "''" represents a second time differentiation $d^2/dt^2$, Δ is a infinitesimal fluctuation around :a steady levitated state, $L_{x0}$ is a self-inductance of each coils 20 and 20' at a steady levitated state, $M_{x0}$ is a mutual inductance of coils 20 and 20' at a steady levitated state, R is a reluctance of each coils 20 and

20', N is the number of turns of each coils 20 and 20', $i_y$, $i_x$, $i_\theta$, $i_\xi$ and $i_\psi$ are exciting currents of the respective y, x, θ, ξ and ψ modes, $e_y$, $e_x$, $e_\theta$, $e_{86}$ and $e_\psi$ are exciting voltages of the respective y, x, θ, ξ and ψ modes, $l_\theta$ is each of the spans of the magnet units 15*a* and 15*d*, and of the magnet units 15*b* and 15*c*, and $l_\psi$ represents each of the spans of the magnet units 15*a* and 15*b*, and of the magnet units 15*c* and 15*d*.

Moreover, voltage equations of the remaining ζ, δ and γ modes are given as follows.

Formula 6 is as follows:

$$(L_{x0} + M_{x0})\Delta i'_\zeta = -N\frac{\partial \Phi_{b1}}{\partial x_b}\Delta\zeta' - R\Delta i_\zeta + e_\zeta$$

$$\Delta\zeta' = \frac{\Delta x_a + \Delta x_b + \Delta x_c + \Delta x_d}{4}$$

$$\Delta i_\zeta = \frac{\Delta i_{xa} + \Delta i_{xb} + \Delta i_{xc} + \Delta i_{xd}}{4}$$

$$e_\zeta = \frac{\Delta e_{xa} + \Delta e_{xb} + \Delta e_{xc} + \Delta e_{xd}}{4}$$

Formula 7 is as follows:

$$(L_{x0} - M_{x0})\Delta i'_\delta = -N\frac{\partial \Phi_{b1}}{\partial y_b}\Delta\delta'' - R\Delta i_\delta + e_\delta$$

$$\Delta\delta = \frac{\Delta y_a - \Delta y_b + \Delta y_c - \Delta y_d}{2l_\psi}$$

$$\Delta i_\delta = \frac{\Delta i_{ya} - \Delta i_{yb} + \Delta i_{yc} - \Delta i_{yd}}{2l_\psi}$$

$$e_\delta = \frac{\Delta e_{ya} - \Delta e_{yb} + \Delta e_{yc} - \Delta e_{yd}}{2l_\psi}$$

Formula 8 is as follows:

$$(L_{x0} + M_{x0})\Delta i'_\gamma = -N\frac{\partial \Phi_{b1}}{\partial x_b}\Delta\gamma' - R\Delta i_\gamma + e_\gamma$$

$$\Delta\gamma = \frac{\Delta x_a + \Delta x_b - \Delta x_c - \Delta x_d}{2l_\theta}$$

$$\Delta i_\gamma = \frac{\Delta i_{xa} + \Delta i_{xb} - \Delta i_{xc} - \Delta i_{xd}}{2l_\theta}$$

$$e_\gamma = \frac{\Delta e_{xa} + \Delta e_{xb} - \Delta e_{xc} - \Delta e_{xd}}{2l_\theta}$$

With respect to the above formulas, y is variation of the center of the movable unit 4 in the y-axis direction, x is variation of the center of the movable unit 4 in the x-axis direction, θ is a rolling angle about the y-axis, ξ is a pitching angle about the x-axis, ψ is a yawing angle about the z-axis, and the guide rails 2 and 2' are the reference points. In case the optical path 7*a* (or 7*b*) is the reference point, a suffix "ab" is added. $y_{ab}$ is a variation of the center of the movable unit 4 in the y-axis direction. $x_{ab}$ is a variation of the center of the movable unit 4 in the x-axis direction. $\theta_{ab}$ is a rolling angle about the y-axis. $\xi_{ab}$ is a pitching angle about the x-axis. $\psi_{ab}$ is a yawing angle about the z-axis. Symbols y, x, θ, ξ and ψ of the respective modes are affixed to exciting currents i and exciting voltages e respectively. Further, symbols a–d representing which of the magnet units 15*a*–15*d* are respectively affixed to exciting currents i and exciting voltages e of the magnet units 15*a*–15*d*. Levitation gaps $x_a$–$x_d$ and $y_a$–$y_d$ to the magnet units 15*a*–15*d* are made by a coordinate transformation into y, x, θ, ξ and ψ modes by the following formula 9.

Formula 9 is as follows:

$$y = \frac{1}{4}(y_a + y_b + y_c + y_d)$$

$$x = \frac{1}{4}(-x_a + x_b + x_c - x_d)$$

$$\theta = \frac{1}{2l_\theta}(-x_a + x_b - x_c + x_d)$$

$$\xi = \frac{1}{2l_\theta}(-y_a - y_b + y_c + y_d)$$

$$\Psi = \frac{1}{2l_\psi}(y_a - y_b - y_c + y_d)$$

Exciting currents $i_{a1}$,$i_{a2}$–$i_{d1}$, $i_{d2}$ to the magnet units 15*a* 15*d* are made a coordinate transformation into exciting currents $i_y$, $i_x$, $i_\theta$, $i_\xi$, $i_\psi$, $i_\zeta$, $i_\delta$ and $i_\gamma$ the respective modes by the following formula 10.

Formula 10 is as follows:

$$i_y = \frac{1}{8}(i_{a1} - i_{a2} + i_{b1} - i_{b2} + i_{c1} - i_{c2} + i_{d1} - i_{d2})$$

$$i_x = \frac{1}{8}(-i_{a1} - i_{a2} + i_{b1} + i_{b2} + i_{c1} + i_{c2} - i_{d1} - i_{d2})$$

$$i_\theta = \frac{1}{4l_\theta}(-i_{a1} - i_{a2} + i_{b1} + i_{b2} - i_{c1} - i_{c2} + i_{d1} + i_{d2})$$

$$i_\xi = \frac{1}{4l_\theta}(-i_{a1} + i_{a2} - i_{b1} + i_{b2} + i_{c1} - i_{c2} + i_{d1} - i_{d2})$$

$$i_\psi = \frac{1}{4l_\psi}(i_{a1} - i_{a2} - i_{b1} + i_{b2} - i_{c1} + i_{c2} + i_{d1} - i_{d2})$$

$$i_\zeta = \frac{1}{8}(i_{a1} + i_{a2} + i_{b1} + i_{b2} + i_{c1} + i_{c2} + i_{d1} + i_{d2})$$

$$i_\delta = \frac{1}{4l_\psi}(i_{a1} - i_{a2} - i_{b1} + i_{b2} + i_{c1} - i_{c2} - i_{d1} + i_{d2})$$

$$i_\gamma = \frac{1}{4l_\theta}(i_{a1} + i_{a2} + i_{b1} + i_{b2} - i_{c1} - i_{c2} - i_{d1} - i_{d2})$$

Controlled input signals to levitation systems of the respective modes, for example, exciting voltages $e_y$, $e_x$, $e_\theta$, $e_\xi$, $e_\psi$, $e_\zeta$, $e_\delta$ and $e_\gamma$ which are the outputs of the calculator 32, are made by an inverse transformation to exciting voltages of the coils 20 and 20' of the magnet units 15*a*–15*d* by the following formula 11.

Formula 11 is as follows:

$$e_{a1} = e_y - e_x - \frac{l_\theta}{2}e_\theta - \frac{l_\theta}{2}e_\xi + \frac{l_\psi}{2}e_\psi + e_\zeta + \frac{l_\psi}{2}e_\delta + \frac{l_\theta}{2}e_\gamma$$

$$e_{a2} = -e_y - e_x - \frac{l_\theta}{2}e_\theta - \frac{l_\theta}{2}e_\xi - \frac{l_\psi}{2}e_\psi + e_\zeta - \frac{l_\psi}{2}e_\delta + \frac{l_\theta}{2}e_\gamma$$

$$e_{b1} = e_y + e_x + \frac{l_\theta}{2}e_\theta - \frac{l_\theta}{2}e_\xi - \frac{l_\psi}{2}e_\psi + e_\zeta - \frac{l_\psi}{2}e_\delta + \frac{l_\theta}{2}e_\gamma$$

$$e_{b2} = -e_y + e_x + \frac{l_\theta}{2}e_\theta + \frac{l_\theta}{2}e_\xi + \frac{l_\psi}{2}e_\psi + e_\zeta + \frac{l_\psi}{2}e_\delta + \frac{l_\theta}{2}e_\gamma$$

$$e_{c1} = e_y + e_x - \frac{l_\theta}{2}e_\theta + \frac{l_\theta}{2}e_\xi - \frac{l_\psi}{2}e_\psi + e_\zeta + \frac{l_\psi}{2}e_\delta - \frac{l_\theta}{2}e_\gamma$$

$$e_{c2} = -e_y + e_x - \frac{l_\theta}{2}e_\theta - \frac{l_\theta}{2}e_\xi + \frac{l_\psi}{2}e_\psi + e_\zeta - \frac{l_\psi}{2}e_\delta - \frac{l_\theta}{2}e_\gamma$$

$$e_{d1} = e_y - e_x + \frac{l_\theta}{2}e_\theta + \frac{l_\theta}{2}e_\xi + \frac{l_\psi}{2}e_\psi + e_\zeta - \frac{l_\psi}{2}e_\delta - \frac{l_\theta}{2}e_\gamma$$

$$e_{d2} = -e_y - e_x + \frac{l_\theta}{2}e_\theta - \frac{l_\theta}{2}e_\xi - \frac{l_\psi}{2}e_\psi + e_\zeta + \frac{l_\psi}{2}e_\delta - \frac{l_\theta}{2}e_\gamma$$

With respect to the y, x, θ, ξ and ψ modes , since motion equations of the movable unit 4 pairs with voltage equations thereof, the formulas 15 are arranged to an equation of state shown in the following formula 12.

Formula 12 is as follows:

$$x^{5\prime}=A_5x_5+b_5e_5+p_5h_5+d_5u_5$$

In the formula 12, vectors $x_5$, $A_5$, $b_5$, $p_5$ and $d_5$, and $u_5$ are defined as follows by formula 13.

Formula 13 is as follows:

$$x_5=\begin{bmatrix}\Delta y\\ \Delta y_{ab}\\ \Delta y'\\ \Delta y'_{ab}\\ \Delta i_y\end{bmatrix},\begin{bmatrix}\Delta x\\ \Delta x_{ab}\\ \Delta x'\\ \Delta x'_{ab}\\ \Delta i_x\end{bmatrix},\begin{bmatrix}\Delta\theta\\ \Delta\theta_{ab}\\ \Delta\theta'\\ \Delta\theta_{ab}\\ \Delta i_\theta\end{bmatrix},\begin{bmatrix}\Delta\xi\\ \Delta\xi_{ab}\\ \Delta\xi'\\ \Delta\xi'_{ab}\\ \Delta i_\xi\end{bmatrix}\text{ or }\begin{bmatrix}\Delta\psi\\ \Delta\psi_{ab}\\ \Delta\psi'\\ \Delta\psi'_{ab}\\ \Delta i_\psi\end{bmatrix}$$

$$A_5=\begin{bmatrix}0&0&1&0&0\\0&0&0&1&0\\a_{21}&0&0&0&a_{23}\\a_{21}&0&0&0&a_{23}\\0&0&a_{32}&0&a_{33}\end{bmatrix}$$

$$b_5=\begin{bmatrix}0\\0\\0\\0\\b_{31}\end{bmatrix},\ d_5=\begin{bmatrix}0\\0\\d_{21}\\d_{21}\\0\end{bmatrix},\ p_5=\begin{bmatrix}0\\0\\-1\\0\\0\end{bmatrix}$$

$$u_5=U_y,\ U_x,\ T_\theta,\ T_\xi,\text{ or }T_\psi$$

wherein $h_5$ represents irregularities on the guide rail 2 (2') to the optical path 7*a* (7*b*).

Where the following formula 14 is provided, $h_5$ is defined by a formula 15.

Formula 14 is as follows:

$$h_y=y_{ab}-y,h_x=x_{ab}-x,h_\theta=\theta_{ab}-\theta$$

$$h_\xi=\xi_{ab}-\xi,h_\psi=\psi_{ab}-\psi$$

Formula 15 is as follows:

$$h_5=h_y'',h_x'',h^{\theta\prime\prime},h_\xi'',h_\psi''$$

Further, $e_5$ is a controlling voltage for stabilizing the respective modes.

Formula 16 is as follows:

$$e_5=e_y,e_x,e_\theta,e_\xi''\text{or}''e_\psi$$

The formulas 6–8 are arranged into an equation of state shown in the following formula 18, by defining a state variable as the following formula 17.

Formula 17 is as follows:

$$x_1=\Delta i_\zeta,\Delta i_\delta,\Delta i_\gamma$$

Formula 18 is as follows:

$$x_1'=A_1x_1+b_1e_{1+d1}u_1$$

If offset voltages of the controller 32 in the respective modes are marked with $v_\zeta$, $v_\delta$ and $v_\gamma$, $A_1$, $b_1$, $d_1$ and $u_1$ in each mode are presented as follows.

Formula 19 is as follows:

($\zeta$-mode)

$$A_l=-\frac{R}{L_{x0}+M_{x0}},\ b_l=\frac{1}{L_{x0}+M_{x0}},\ d_l=\frac{1}{L_{x0}+M_{x0}}$$

$$u_l=-N\frac{\partial\Phi_{bl}}{\partial x_b}\Delta\zeta'+v_\zeta$$

($\delta$-mode)

$$A_l=-\frac{R}{L_{x0}-M_{x0}},\ b_l=\frac{1}{L_{x0}-M_{x0}},\ d_l=\frac{1}{L_{x0}-M_{x0}}$$

$$u_l=-N\frac{\partial\Phi_{bl}}{\partial y_b}\Delta\delta'+v_\delta$$

($\gamma$-mode)

$$A_l=-\frac{R}{L_{x0}+M_{x0}},\ b_l=\frac{1}{L_{x0}+M_{x0}},\ d_1=\frac{1}{L_{x0}+M_{x0}}$$

$$u_l=-N\frac{\partial\Phi_{bl}}{\partial x_b}\Delta\gamma'+v_\gamma$$

wherein $e_1$ is a controlling voltage of each mode.

Formula 20 is as follows:

$$e_1=e_\zeta,e_\delta,\text{or}e_\gamma$$

The formula 12 may achieve a zero power control by feedback of the following formula 21.

Formula 21 is as follows:

$$e_5=F_5x_5+\int K_5x_5dt$$

In case of letting $F_a$, $F_b$, $F_c$, $F_d$ and $F_e$ be proportional gains, and $K_e$ be integral gain, the following formula 22 is given.

Formula 22 is as follows:

$$F_3=[F_aF_bF_cF_dF_e]$$

$$K_3=[0000K_e]$$

Likewise, the formula 18 may achieve a zero power control by feedback of the following formula 23.

Formula 23 is as follows:

$$e_1=F_1x_1+\int K_1x_1dt$$

$F_1$ is a proportional gain. $K_1$ is an integral gain.

As shown in FIG. 5, the calculator 32, which provides the above zero power control, comprises subtractors 41*a*–41*h*, 42*a*–42*h* and 43*a*–43*h*, average calculators 44*x* and 44*y*, a gap deviation coordinate transformation circuit 45, a current deviation coordinate transformation circuit 46, a controlling voltage calculator 47, a controlling voltage coordinate inverse transformation circuit 48, a vertical position calculator 49, a position deviation coordinate transformation circuit 50, and an irregularity memory circuit 51. The calculator 32 providese not only the zero power control but also a guide control on the basis of a reference coordinate by detecting a position of the movable unit 4 by using the photodiodes 8*a*, 8*b* and 8*c*, and the optical paths 7*a*, 7*b* and 7*c* formed by the laser radiators 6*a*, 6*b* and 6*c*.

The subtractors 41*a*–41*h* calculate x-direction gap deviation signals $\Delta g_{xa1}$, $\Delta g_{xa2}$,$-\Delta g_{xd1}$, $\Delta g_{xd2}$ by subtracting the respective reference values $x_{a01}$, $x_{a02}$, $-x_{d01}$, $x_{d02}$ from gap signals $g_{xa1}$, $g_{xa2}$,$-g_{xd1}$, $g_{xd2}$ from the x-direction gap sensors 13*a*, 13'*a*–13*d*, 13'*d*. The subtractors 42*a*–42*h* calculate y-direction gap deviation signals $\Delta g_{ya1}$, $\Delta g_{ya2}$,$-\Delta g_{yd1}$, $\Delta g_{yd2}$ by subtracting the respective reference values $y_{a01}$, $y_{a02}$, $-y_{d01}$, $y_{d02}$ from gap signals $g_{ya1}$, $g_{ya2}$, $g_{yd1}$, $g_{yd2}$ from the y-direction gap sensors 14*a*, 14'*a*–14*d*, 14'*d*. The subtractors 43*a*–43*h* calculate current deviation signals $\Delta i_{a1}$, $\Delta i_{a2}$,$-\Delta i_{d1}$, $\Delta i_{d2}$ by subtracting the respective reference values $i_{a01}$, $i_{a02}$,$-i_{d01}$, $i_{d02}$ from exciting current signals $i_{a1}$, $i_{a2}$,$-i_{d1}$, $i_{d2}$ from current detectors 36*a*, 36'*a*–36*d*, 36'*d*.

The average calculators 44*x* and 44*y* average the x-direction gap deviation signals $\Delta g_{xa1}$, $\Delta g_{xa2}$,$-\Delta g_{xd1}$, $\Delta g_{xd2}$, and the y-direction gap deviation signals $\Delta g_{ya1}$, $\Delta g_{ya2}$, $-\Delta g_{yd1}$, $\Delta g_{yd2}$ respectively, and output the calculated x-direction gap deviation signals $\Delta x_a$–$\Delta x_d$, and the calculated y-direction gap deviation signals $\Delta y_a$–$\Delta y_d$. The gap deviation coordinate transformation circuit 45 calculates y-direction variation $\Delta y$ of the center of the movable unit 4 on the basis of the y-direction gap deviation signals $\Delta y_a$–$\Delta y_d$, x-direction variation $\Delta x$ of the center of the movable unit 4 on the basis of the x-direction gap deviation signals $\Delta x_a$–$\Delta x_d$, a rotation angle $\Delta\theta$ in the $\theta$-direction (rolling direction) of the center of the movable unit 4, a rotation angle $\Delta\xi$ in the $\xi$-direction(pitching direction) of the movable unit 4, and a rotation angle $\Delta\psi$ in the $\psi$-direction (yawing direction) of the movable unit 4, by the use of the formula 9.

The current deviation coordinate transformation circuit 46 calculates a current deviation $\Delta i_y$ regarding y-direction movement of the center of the movable unit 4, a current deviation $\Delta i_x$ regarding x-direction movement of the center of the movable unit 4, a current deviation $\Delta i_\theta$ regarding a rolling around the center of the movable unit 4, a current deviation $\Delta i_\xi$ regarding a pitching around the center of the movable unit 4, a current deviation $\Delta i_\psi$ regarding a yawing around the center of the movable unit 4, and current deviations $\Delta i_\zeta$, $\Delta i_\delta$ and $\Delta i_\gamma$, regarding $\zeta$, $\delta$ and $\gamma$ stressing the movable unit 4, on the basis of the current deviation signals $\Delta i_{a1}$, $\Delta i_{a2}$,$-\Delta i_{d1}$, $\Delta i_{d2}$ by using the formula 10.

The vertical position calculator 49 calculates a vertical position of the movable unit 4 in the hoistway 1 on the basis of the outputs of the photodiodes 8*b* and 8*c* disposed at the same level. The position deviation coordinate transformation circuit 50 calculates positions $\Delta y_{ab}$, $\Delta x_{ab}$, $\Delta\theta_{ab}$, $\Delta\xi_{ab}$ and $\Delta\psi_{ab}$ in each mode of the movable unit 4 on the reference coordinate on the basis of the outputs of the photodiodes 8*a* and 8*b*, and outputs the calculated results to the controlling voltage calculator 47.

The irregularity memory circuit 51 subtracts an output of the gap deviation coordinate transformation circuit 45 from a position of the movable unit 4 measured by the vertical position calculator 49 and an output of the position deviation coordinate transformation circuit 50, and then consecutively stores irregularity data $h_y$, $h_x$, $h_\theta$, $h_\xi$ and $h_\psi$ of the guide rail 2(2') to the optical path 7*a* (7*b* ), which are transformed into a position of the movable unit 4. The irregularity memory circuit 51 timely reads vertical position data and the irregularity data corresponding to a vertical position of the movable unit 4 and outputs them to the controlling voltage calculator 47.

The controlling voltage calculator 47 calculates controlling voltages $e_y$, $e_x$, $e_\theta$, $e_\xi$, $e_\psi$, $e_\zeta$, $e_\delta$ and $e_\gamma$ for magnetically and securely levitating the movable unit 4 in each of the y, x, $\theta$, $\xi$, $\psi$, $\zeta$, $\delta$, and $\gamma$ modes on the basis of the outputs $\Delta y$, $\Delta x$, $\Delta\theta$, $\Delta\xi$, $\Delta\psi$, $\Delta i_y$, $\Delta i_x$, $\Delta i_\theta$, $\Delta i_\xi$, $\Delta i_\psi$, $\Delta i_\zeta$, $\Delta i_\delta$ and $\Delta i_\gamma$ of the gap deviation coordinate transformation circuit 45 and the current deviation coordinate transformation circuit 46. The controlling voltage coordinate inverse transformation circuit 48 calculates respective exciting voltages $e_{a1}$,$e_{a2}$–$e_{d1}$,$e_{d2}$ of the magnet units 15*a*–15*d* on the basis of the outputs $e_y$, $e_x$, $e_\theta$, $e_\xi$, $e_\psi$, $e_\zeta$, $e_\delta$ and $e_\gamma$ by the use of the formula 11, and feeds back the calculated result to the power amplifiers 33*a*,33'*a*–33*d*,33'*d*.

The controlling voltage calculator 47 comprises a back and forth mode calculator 47*a*, a right and left mode calculator 47*b*, a roll mode calculator 47*c*, a pitch mode calculator 47*d*, a yaw mode calculator 47*e*, an attractive mode calculator 47*f*, a torsion mode calculator 47*g*, and a strain mode calculator 47*h*.

The back and forth mode calculator 47*a* calculates an exciting voltage $e_\gamma$ in the y-mode on the basis of the formula 21 by using inputs $\Delta y$ and $\Delta i_y$. The right and left mode calculator 47*b* calculates an exciting voltage $e_x$ in the x-mode on the basis of the formula 21 by using inputs $\Delta x$ and $\Delta i_x$. The roll mode calculator 47*c* calculates an exciting voltage $e_\theta$ in the $\theta$-mode on the basis of the formula 21 by using inputs $\Delta\theta$ and $\Delta i_\theta$. The pitch mode calculator 47*d* calculates an exciting voltage $e_\xi$ in the $\xi$-mode on the basis of the formula 21 by using inputs $\Delta\xi$ and $\Delta i_\xi$. The yaw mode calculator 47*e* calculates an exciting voltage $e_\psi$ in the $\psi$-mode on the basis of the formula 21 by using inputs $\Delta\psi$ and $\Delta i_\psi$. The attractive mode calculator 47*f* calculates an exciting voltage $e_\zeta$ in the $\zeta$-mode on the basis of the formula 23 by using input $\Delta i_\zeta$. The torsion mode calculator 47*g* calculates an exciting voltage $e_\delta$ in the $\delta$-mode on the basis of the formula 23 by using input $\Delta i_\delta$. The strain mode calculator 47*h* calculates an exciting voltage $e_\gamma$ in the $\gamma$-mode on the basis of the formula 23 by using input $\Delta i_\gamma$.

Figure 6:
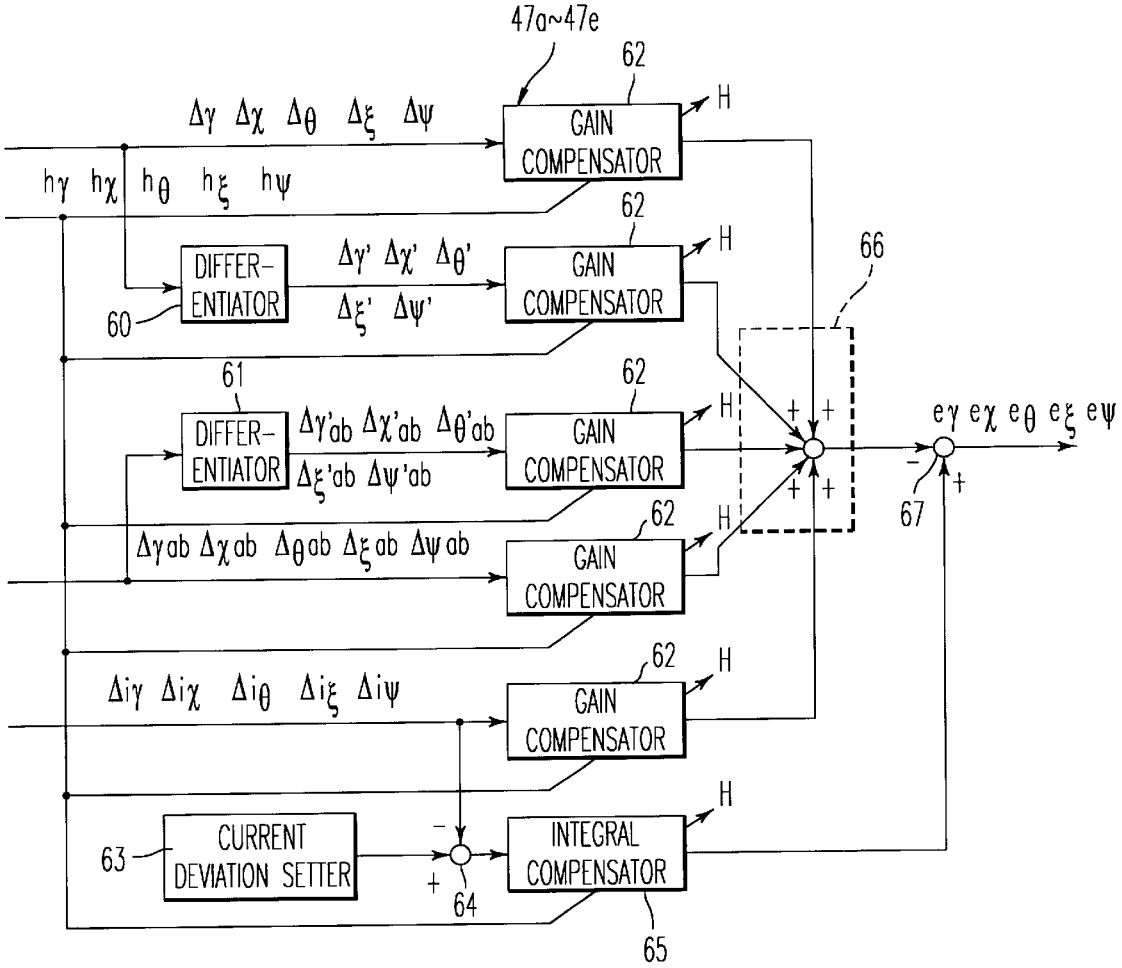
FIG. 6 is a block diagram showing a circuit of a controlling voltage calculator of the controller.

FIG. 6 shows in detail each of the calculators 47*a*–47*e*.

Each of the calculators 47*a*–47*e* comprises a differentiator 60 calculating time change rate $\Delta y'$, $\Delta x'$, $\Delta\theta'$, $\Delta\xi'$ or $\Delta\psi'$ on the basis of each of the variations $\Delta y$, $\Delta x$, $\Delta\theta$, $\Delta\xi$ and $\Delta\xi$, a differentiator 61 calculating time change rate $\Delta y'_{ab}$, $\Delta x'_{ab}$, $\Delta\theta_{ab}$, $\Delta\xi_{ab}$ or $\Delta\psi'_{ab}$ on the basis of each of the variations $\Delta y_{ab}$, $\Delta x_{ab}$, $\Delta\theta_{ab}$, $\Delta\xi_{ab}$ and $\Delta\psi_{ab}$ from the reference position, and gain compensators 62 multiplying each of the variations $\Delta y$–$\Delta\psi$ and $\Delta y_{ab}$–$\Delta\psi_{ab}$, each of the time change rates $\Delta y'$–$\Delta\psi'$ and $\Delta y'_{ab}$–$\Delta\psi'_{ab}$ and each of the current deviations $\Delta i_y$–$\Delta i_\psi$, by an appropriate feedback gain respectively. Each of the calculators 47*a*–47*e* also comprises a current deviation setter 63, a subtractor 64 subtracting each of the current deviations $\Delta i_y$–$\Delta i_\psi$ from a reference value output by the current deviation setter 63, an integral compensator 65 integrating the output of the subtractor 64 and multiplying the integrated result by an appropriate feed back gain, an adder 66 calculating the sum of the outputs of the gain compensators 62, and a subtractor 67 subtracting the output of the adder 66 from the output of the integral compensator 65, and outputting the exciting voltage $e_y$, $e_x$, $e_\theta$, $e_\xi$ or $e_\psi$, of the respective y, x, $\theta$, $\xi$ and $\psi$ modes. The gain compensator 62 and the integral compensator 65 may change a set gain on the basis of vertical position data H and the irregularity data $h_y$, $h_x$, $h_\theta$, $h_\xi$ and $h_\psi$ corresponding to a vertical position of the movable unit 4.

Figure 7:
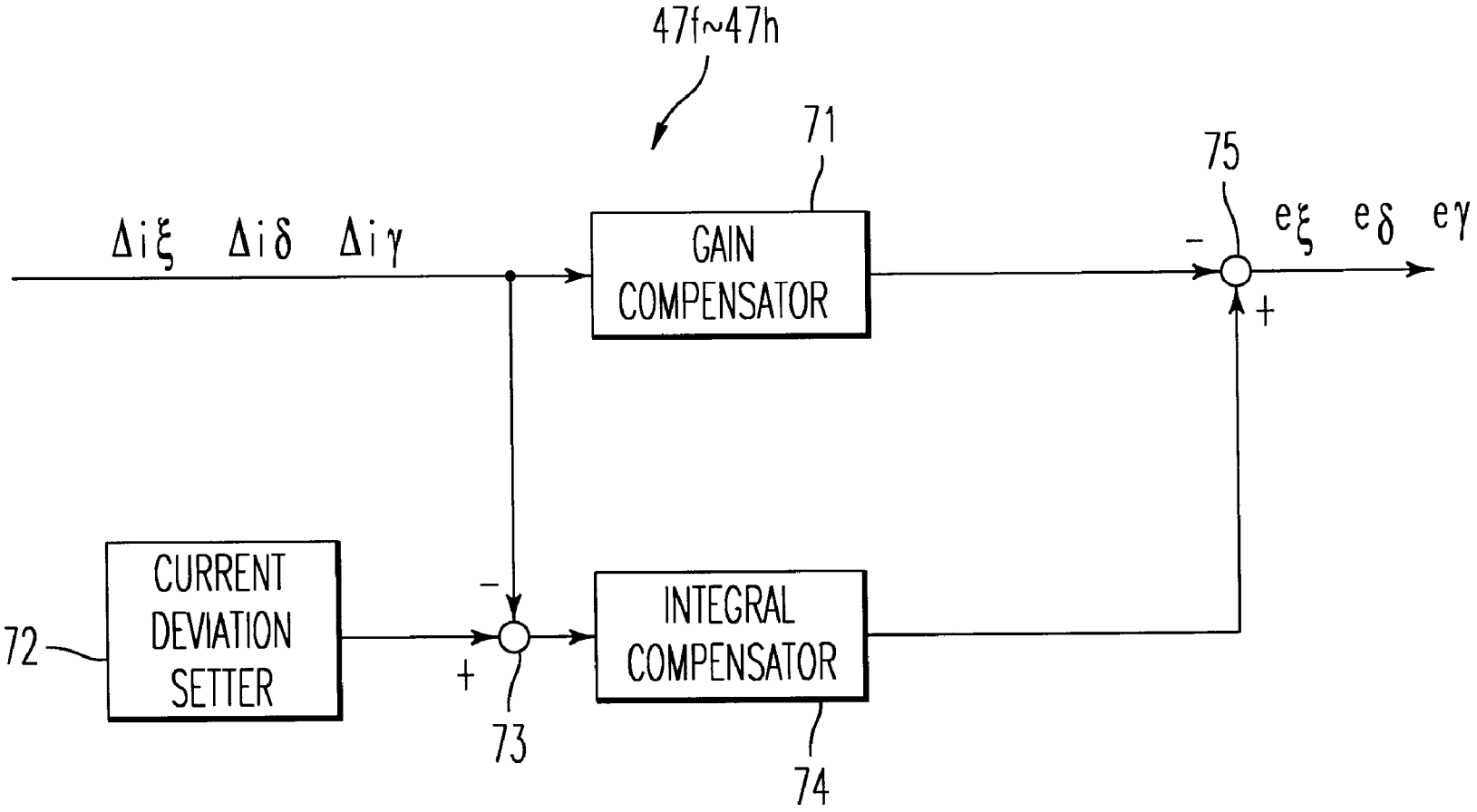
FIG. 7 is a block diagram showing a circuit of another controlling voltage calculator of the controller.

FIG. 7 shows internal components in common among the calculators 47*f*–47*h*.

Each of the calculators 47*f*–47*h* comprises a gain compensator 71 multiplying the current deviation $\Delta i_\zeta$, $\Delta i_\delta$ or $\Delta i_\gamma$ by an appropriate feedback gain, a current deviation setter 72, a subtractor 73 subtracting the current deviation $\Delta i_\zeta$, $\Delta i_\delta$ or $\Delta i_\gamma$ from a reference value output by the current deviation setter 72, an integral compensator 74 integrating the output of the subtractor 73 and multiplying the integrated result by an appropriate feedback gain, and a subtractor 75 subtracting the output of the gain compensator 71 from the output of the integral compensator 74 and outputting an exciting voltage $e_\zeta$, $e_\delta$ or $e_\gamma$ of the respective $\zeta$, $\delta$ and $\gamma$ modes.

The following explains an operation of the above-described guide system of the first embodiment of the present invention.

Any of the ends of the center cores 16 of the magnet units 15*a*–15*d*, or the ends of the electromagnets 18 and 18' of the magnet units 15*a*–15*d* adsorb to the facing surfaces of the guide rails 2 and 2' through the solid lubricating materials 22 at a stopping state of the magnetic guide system. At this time, an upward and downward movement of the movable unit 4 is not interfered with because of the effect of the solid lubricating materials 22.

Once the guide system is activated at the stopping state, fluxes of the electromagnets 18 and 18', which possesses the same or opposite direction of fluxes generated by the permanent magnets 17 and 17', are controlled by the controller 30. The controller 30 controls exciting currents to the coils 20 and 20' in order to keep a predetermined gap between the magnet units 15*a*–15*d* and guide rails 2 and 2'. Consequently, as shown in FIG. 4, a magnetic circuit Mcb is formed with a path of the permanent magnet 17, the L-shaped core 19, the core plate 21, the gap Gb, the guide rail 2', the gap Gb", the center core 16, and the permanent magnet 17; and a magnetic circuit Mcb' is formed with a path of the permanent magnet 17', the L-shaped core 19', the core plate 21', the gap Gb', the guide rail 2', the gap Gb", the center core 16, and the permanent magnet 17'. The gaps Gb, Gb' and Gb" , or other gaps formed with the magnet units 15*a*, 15*c* and 15*d*, are set to certain distances so that magnetic attractive forces of the magnet units 15*a*–15*d* generated by the permanent magnets 17 and 17' balance with a force in the y-direction (back and force direction) acting on the center of the movable unit 4, a force in the x-direction (right and left direction), and torques acting around the x, y and x-axis passing on the center of the movable unit 4. When some external forces operate on the movable unit 4, the controller 30 controls exciting currents flowing into the electromagnets 18 and 18' of the respective magnet units 15*a*–15*d* in order to keep such balance, thereby achieving the so-called zero power control.

Now, the movable unit 4 is positioned at the lowest floor. The movable unit 4, which is controlled to be guided with no contact by the zero power control, starts to move upwardly by a hoisting machine (not shown). In this first upward stage, the movable unit moves slowly enough so that the zero power control can control to follow irregularities on the guide rails. During the first initial running, positions H of the movable unit 4 and the irregularity data $h_y$, $h_x$, $h_\theta$, $h_\xi$ and $h_\psi$ are stored in the irregularity memory circuit 51. Consequently, outputs of the irregularity memory circuit 51 are zero during the first initial running. After the first initial running and storing of the position data H and the irregularity data from the lowest floor to the highest floor, the collected data is used for the next running. The position data H and the irregularity data may be rewritten in the same way as the above-described method at any time, if necessary.

After the first initial running, a guide control is carried out as follows. When the movable unit 4 passes relatively gentle irregularities such as warps, a shake of the movable unit 4 caused by irregularities on the guide rails 2 and 2' may be restrained effectively, since the controller 30 feeds back each of the variations $\Delta y$–$\Delta\psi$ and $\Delta y_{ab}$–$\Delta\psi_{ab}$ and each of the time change rates $\Delta y'$–$\Delta\psi'$ and $\Delta y'_{ab}$–$\Delta\psi'_{ab}$ to each of the exciting voltages $e_y$, $e_x$, $e_\theta$, $e_\xi$ and $e_\psi$ via the gain compensator 62.

Since the irregularity data $h_y$, $h_x$, $h_\theta$, $h_\xi$ and $h_\psi$ and the vertical position data H are read out by the irregularity memory circuit 51 and the gain compensator 62 and the integral compensator 65 input these data, the gain compensator 62 and the integral compensator 65 may change controlling parameters at intervals having irregularities during a later running, if vertical position data and the intervals having irregularities are set to the gain compensator 62 and the integral compensator 65 after the initial running.

Even if a difference in level or a gap caused by a repetition of thermal expansion and contraction or an earthquake occur at a joint of the guide rail 2(2'), a shake of the movable unit 4 may be restrained by changing controlling parameters so that guiding forces of the magnet units 15*a*–15*d* possess an extremely low spring constant on the condition that the movable unit 4 positions at the interval having irregularity, a velocity of the movable unit 4 is fast, and a change rate of the irregularity data $h_y$, $h_x$, $h_\theta$, $h_\xi$ and $h_\psi$ exceeds the predetermined value.

In case the magnetic guide system stops working, the current deviation setters 62 for the y-mode and the x-mode set reference values from zero to minus values gradually, whereby the movable unit 4 gradually moves in the y and x-directions. At last, any of the ends of the center cores 16 of the magnet units 15*a*–15*d*, or the ends of the electromagnets 18 and 18' of the magnet units 15*a*–15*d* adsorb to the facing surfaces of the guide rails 2 and 2' through the solid lubricating materials 22. If the magnetic guide system is stopped at this state, a reference value of the current deviation setter 62 is reset to zero, and the movable unit 4 adsorbs to the guide rails 2 and 2'.

In the first embodiment, although the zero power control, which controls to settle an exciting current for an electromagnet to zero at a steady state, is adopted for no contact guide control, various other control methods for controlling attractive forces of the magnet units 15*a*–15*d* may be used. For example, a control method, which controls to keep the gaps constant, may be adopted, if the magnet units areto follow the guide rails 2 and 2' more precisely.

Figure 8:
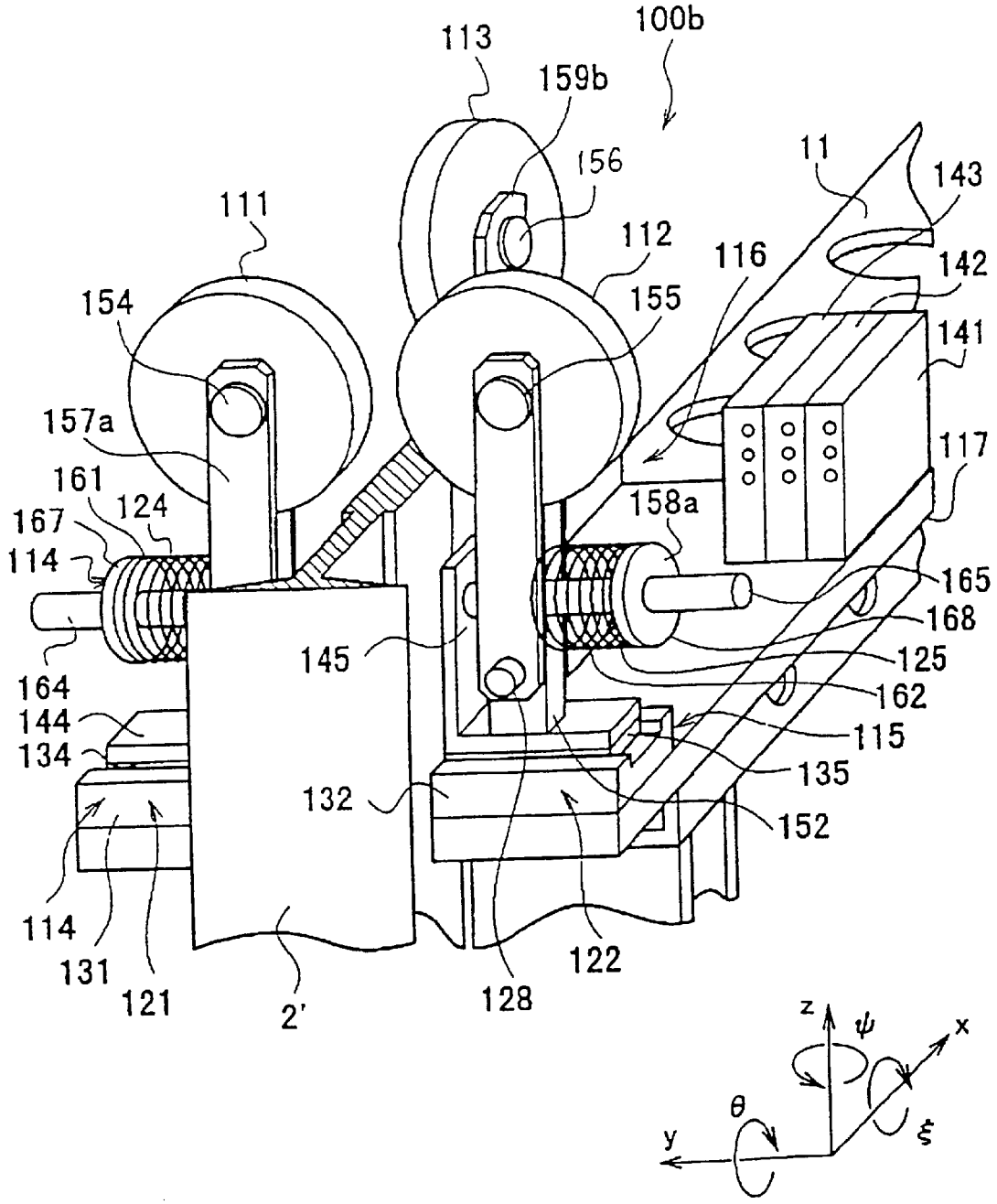
FIG. 8 is a perspective view showing a structure of a guide unit of a guide system of a second embodiment.
Figure 9:
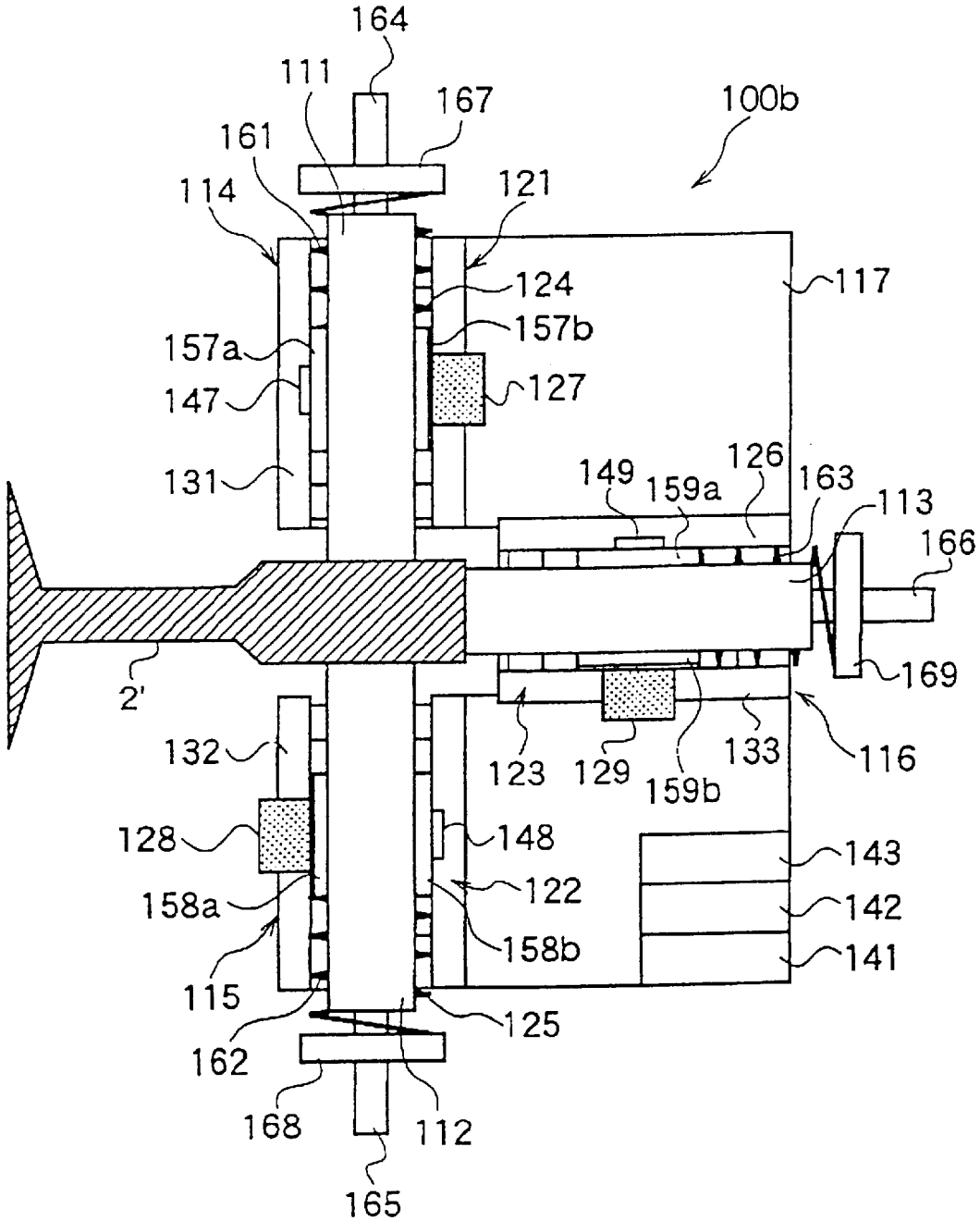
FIG. 9 is a plan view showing the guide unit of the second embodiment.

A guide system of a second embodiment of the present invention is described with reference to FIGS. 8 and 9.

In the first embodiment, although no contact guide control is achieved by adopting the magnet units 15*a*–15*d* as guide units 5*a*–5*d*, it is not limited to the above described system. As shown in FIGS. 8 and 9, guide units 100*a*–100*d* in a wheel supporting type may be attached to the upper and lower corners of the movable unit 4 in the same way as the first embodiment. Although only guide unit 100*b* is illustrated in FIGS. 8 and 9, the other guide units 100*a*, 100*c* and 100*d* have the same structure as the guide unit 100*b*.

The guide unit 100*b* of the second embodiment comprises three guide wheels 111, 112 and 113 disposed to surround the guide rail 2(2') on three sides, suspension units 114, 115 and 116, disposed between the respective guide wheels 111–113 and the movable unit 4, operating guiding forces on the guide rail 2(2') by pressing the guide wheels 111–113, and a base supporting the suspension units 114–116.

Each of the guide units 100*a*–110*d* is fixed to a corresponding corner of the frame 11 through the base 117. The suspension units 114–116 each include a respective one of linear pulse motors 121, 122 and 123, suspensions 124, 125 and 126, and potentiometers 127, 128 and 129 for gap sensors.

The linear pulse motors 121–123 comprise respectively stators 131, 132 and 133, and linear rotors 134, 135 and 136. The linear rotors 134–136 move along concave grooves of the stators 131–133 formed in the shape of a U as a whole. Moving speeds of the linear rotors 134–136 correspond to values of speed signals individually provided to pulse motor drivers 141, 142 and 143 of the linear pulse motors 121–123.

The suspensions 124–126 comprise L-shaped plates 144, 145 and 146(not shown) fixed on the linear rotors 134–136, supports 151(not shown), 152 and 153(not shown) fixed on the L-shaped plates 144–146 and including axles 147, 148 and 149 on the opposite sides thereof, pairs of plates 157*a* and 157*b*, 158*a* and 158*b*, and 159*a* and 159*b* pivotably connected to the supports 151–153 by putting the axles 147–149 between the pairs of plates 157*a*,157*b*–159*a*,159*b* at the basal portion thereof, and supporting the guide wheels rotatably by the axles 154, 155 and 156 at the tips thereof by putting the supports 151–153 and the guide wheels 111–113 between the pairs of plates 157*a*,157*b* 159*a*,159*b*. The suspensions 124–126 also comprise coil springs 161, 162 and 163, guiding rods 164, 165 and 166 put through the coil springs 161–163 and fixed to the L-shaped plates 144–146 at the rear ends thereof, and guards 167, 168 and 169 fixed at a position that the each coil spring 161–163 operates a predetermined pressing force on the pairs of plates 157*a*, 157*b*–159*a*,159*b*, and pierced through the guiding rods 164–166.

The potentiometers 127–129 detect turning angles of the pairs of plates 157*a*,157*b*–159*a*,159*b* around the axes 147–149 of the supports 151–153, and function as gap sensors outputing a distance between the guide rail 2(2') and the center of each axles 154, 155 and 156.

Figure 10:
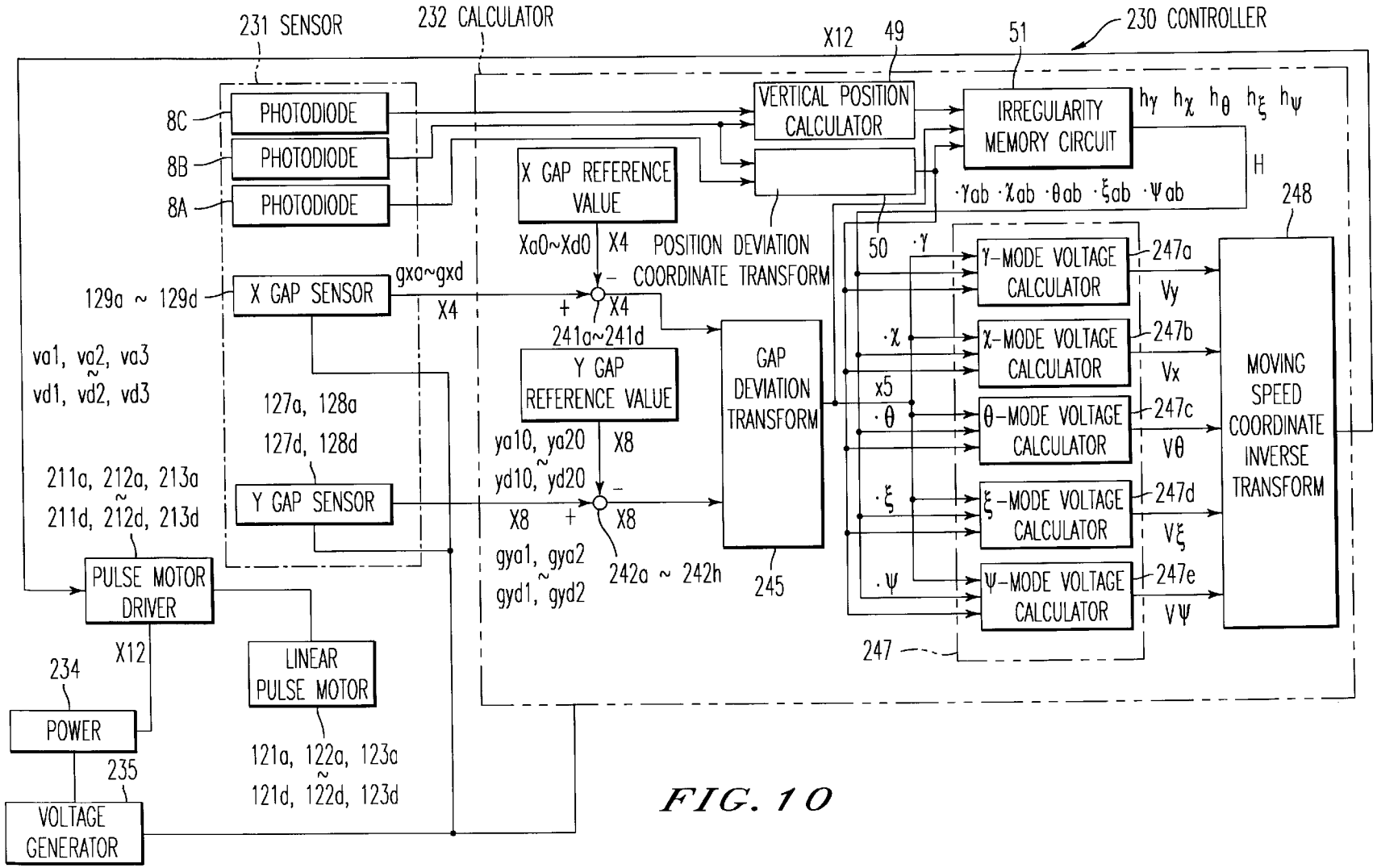
FIG. 10 is a block diagram showing a circuit of a controller of the second embodiment.

A guiding force of each guide wheel 111–113 of the guide units 100*a*–100*d* is controlled by a controller 230 shown in FIG. 10, thereby guiding the elevator cage 10 and the frame 11 against the guide rails 2 and 2'.

The controller 230 is divided and disposed at the same position as the controller 30 of the first embodiment shown in FIG. 1, but functionally combined as a whole as shown in FIG. 10. The following is an explanation of the controller 230. In FIG. 10, arrows represent signal paths, and solid lines represent electric power lines. In the following description, identical numerals are added to the same components as the controller 30 of the first embodiment. Further, suffixes "a"–"d" are respectively added to figures indicating the main components of the respective guide units 100*a*–100*d* in order to indicate instaling positions on the frame 11.

The controller 230, fixed on the frame 11, comprises a sensor 231 detecting a distance between the guide rail 2(2') and the center of each guide wheel 111*a*, 112*a*, 113*a*–111*d*, 112*d*, 113*d* of the guide units 100*a*–100*d*, a calculator 232 calculating a moving speed of each of the moving elements 134–136 of the linear pulse motors 121*a*, 122*a*, 123*a*–121*d*, 122*d*, 123*d* for guiding the movable unit 4 in response to output signals from the sensor 231, pulse motor drivers 211*a*, 212*a*, 213*a*–211*d*, 212*d*, 213*d* driving each moving element 134–136 at a designated speed on the basis of outputs of the calculator 232, thereby controlling a guiding force of each guide wheel 111*a*, 112*a*, 113*a*–111*d*, 112*d*, 113*d* in both x and y directions individually.

A power supply 234 supplies an electric power to the linear pulse motors 121*a*, 122*a*, 123*a*–121*d*, 122*d*, 123*d* through pulse motor drivers 211*a*, 212*a*, 213*a*–211*d*, 212*d*, 213*d* and also supplies an electric power to a constant voltage generator 235 supplying an electric power having a constant voltage to the calculator 232, and the potentiometers 127*a*, 128*a*, 129*a*–127*d*, 128*d*, 129*d* constituting x-direction gap sensors and y-direction gap sensors. The constant voltage generator 235 supplies an electric power with a constant voltage to the calculator 232 and the potentiometers 127*a*, 128*a*, 129*a*–127*d*, 128*d*, 129*d*, even if a voltage of the power supply 234 varies due to an excessive current supply, whereby the calculator 232 and the potentiometers 127*a*, 128*a*, 129*a*–127*d*, 128*d*, 129*d* may normally operate.

The sensor 231 comprises the potentiometers 127*a*, 128*a*, 129*a*–127*d*, 128*d*, 129*d* and the photodiodes 8*a*–8*c*.

Likewise the first embodiment, the calculator 232 controls a guide control for the movable unit 4 in every motion coordinate system shown in FIG. 1. The motion coordinate system includes a y-mode (back and forth motion mode) representing a right and left motion along a y-coordinate on a center of the movable unit 4, an x-mode (right and left motion mode) representing a right and left motion along a x-coordinate, a θ-mode (roll mode) representing a rolling about the center of the movable unit 4, a ξ-mode (pitch mode) representing a pitching about the center of the movable unit 4, and a ψ-mode (yaw-mode) representing a yawing about the center of the movable unit 4.

To simplify the explanation, it is assumed that a center of the movable unit 4 ist on a vertical line crossing a diagonal intersection point of the center points of the guide units 100*a*–100*d* disposed on four corners of the movable unit 4. Where the center is regarded as the origin of respective x, y and z coordinate axes, a motion equation in every mode is given by the following formulas 24 through 28.

Formula 24 is as follows:

$$M\Delta y''_{ab} = -8K_s\Delta y - 8\eta_s\Delta y' - 8K_s v_y + U_y$$

$$\Delta y = \frac{\Delta y_{a1} - \Delta y_{a2} + \Delta y_{b1} - \Delta y_{b2} + \Delta y_{c1} - \Delta y_{c2} + \Delta y_{d1} - \Delta y_{d2}}{8}$$

$$v_y = \frac{v_{a1} - v_{a2} + v_{b1} - v_{b2} + v_{c1} - v_{c2} + v_{d1} - v_{d2}}{8}$$

Formula 25 is as follows:

$$M\Delta x''_{ab} = -4K_s\Delta x - 4\eta_s\Delta x' - 4K_s v_x + U_x$$

$$\Delta x = \frac{-\Delta x_a + \Delta x_b + \Delta x_c - \Delta x_d}{4}$$

$$v_x = \frac{-v_{a3} + v_{b3} + v_{c3} - v_{d3}}{4}$$

Formula 26 is as follows:

$$I_\theta\Delta\theta''_{ab} = -K_s l_\theta^2\Delta\theta - \eta_s l_\theta^2\Delta\theta' - K_s l_\theta^2 v_\theta + T_\theta$$

$$\Delta\theta = \frac{-\Delta x_a + \Delta x_b - \Delta x_c + \Delta x_d}{2l_\theta}$$

$$v_\theta = \frac{-v_{a3} + v_{b3} - v_{c3} + v_{d3}}{2l_\theta}$$

Formula 27 is as follows:

$$I_\xi\Delta\xi''_{ab} = -2K_s l_\theta^2\Delta\xi - 2\eta_s l_\theta^2\Delta\xi' - 2K_s l_\theta^2 v_\xi + T_\xi$$

$$\Delta\xi = \frac{-\Delta y_{a1} + \Delta y_{a2} - \Delta y_{b1} + \Delta y_{b2} + \Delta y_{c1} - \Delta y_{c2} + \Delta y_{d1} - \Delta y_{d2}}{4l_\theta}$$

$$v_\xi = \frac{-v_{a1} + v_{a2} - v_{b1} + v_{b2} + v_{c1} - v_{c2} + v_{d1} - v_{d2}}{4l_\theta}$$

Formula 28 is as follows:

$$I_\theta\Delta\psi''_{ab} = -2K_s l_\psi^2\Delta\psi - 2\eta_s l_\psi^2\Delta\psi' - 2K_s l_\psi^2 v_\psi + T_\psi$$

$$\Delta\psi = \frac{\Delta y_{a1} - \Delta y_{a2} + \Delta y_{b1} - \Delta y_{b2} - \Delta y_{c1} + \Delta y_{c2} - \Delta y_{d1} + \Delta y_{d2}}{4l_\theta}$$

$$v_\psi = \frac{v_{a1} - v_{a2} + v_{b1} - v_{b2} - v_{c1} + v_{c2} - v_{d1} + v_{d2}}{4l_\psi}$$

Ks is a spring constant of each suspension 124–126 per a unit moving distance of each guide wheel 111–113. The term $\eta_s$ is a damping constant of each suspension 124–126 per a unit moving distance of each guide wheel 111–113. The terms $v_y$, $v_x$, $v_\theta$, $v_\xi$ and $v_{104}$ are moving speed command values of moving elements 134136 in the respective y, x, θ, ξ and ψ modes.

Gaps $x_a$–$x_d$ and $y_{a1}$, $y_{a2}$–$y_{d1}$, $y_{d2}$ corresponding to suspension units 114–116 are made by a coordinate transformation into y, x, θ, ξ and ψ coordinates by the following formula 29.

Formula 29 is as follows:

$$y = \frac{1}{8}(y_{a1} - y_{a2} + y_{b1} - y_{b2} + y_{c1} - y_{c2} - y_{d1} + y_{d2})$$

$$x = \frac{1}{4}(-x_a + x_b + x_c - x_d)$$

$$\theta = \frac{1}{2l_\theta}(-x_a + x_b - x_c + x_d)$$

$$\xi = \frac{1}{2l_\theta}(-y_{a1} + y_{a2} - y_{b1} + y_{b2} + y_{c1} - y_{c2} + y_{d1} - y_{d2})$$

$$\psi = \frac{1}{2l_\psi}(y_{a1} - y_{a2} - y_{b1} + y_{b2} - y_{c1} + y_{c2} + y_{d1} - y_{d2})$$

Controlled input signals to suspension systems of the respective modes, for example, moving speed command values $v_y$, $v_x$, $v_\theta$, $v_\xi$ and $v_\psi$ which are the outputs of the calculator 232 are made by an inverse transformation to velocity inputs $v_{a1}$, $v_{a2}$, $v_{a3}$–$v_{d1}$, $v_{d2}$, $v_{d3}$ of the pulse motor drivers 211*a*,212*a*,213*a*–211*d*,212*d*,213*d* by the following formula 30.

Formula 30 is as follows:

$$v_{a1} = v_y - \frac{l_\theta}{2}v_\xi + \frac{l_\psi}{2}v_\psi,$$

$$v_{a2} = -v_y + \frac{l_\theta}{2}v_\xi - \frac{l_\psi}{2}v_\psi,\ v_{a3} = -v_x - \frac{l_\theta}{2}v_\theta$$

$$v_{b1} = v_y - \frac{l_\theta}{2}v_\xi - \frac{l_\psi}{2}v_\psi,\ v_{b2} = -v_y + \frac{l_\theta}{2}v_\xi + \frac{l_\psi}{2}v_\psi,\ v_{b3} = v_x - \frac{l_\theta}{2}v_\theta$$

$$v_{c1} = v_y + \frac{l_\theta}{2}v_\xi - \frac{l_\psi}{2}v_\psi,\ v_{c2} = -v_y - \frac{l_\theta}{2}v_\xi + \frac{l_\psi}{2}v_\psi,\ v_{c3} = v_x - \frac{l_\theta}{2}v_\theta$$

$$v_{d1} = v_y + \frac{l_\theta}{2}v_\xi + \frac{l_\psi}{2}v_\psi,\ v_{d2} = -v_y - \frac{l_\theta}{2}v_\xi - \frac{l_\psi}{2}v_\psi,\ v_{d3} = -v_x + \frac{l_\theta}{2}v_\theta$$

Motion equations of the movable unit 4 with respect to the y, x, θ, ξ and ψ modes expressed by formulas 24–28 are arranged to an equation of state shown in the following formula 31.

Formula 31 is as follows:

$$x'_5 = A_5x_5 + b_5v_5 + p_5h_5 + d_5u_5$$

In the formula 31, vectors $x_5$, $A_5$, $b_5$, $p_5$ and $d_5$, and $u_5$ are defined as follows.

Formula 32 is as follows:

$$x_5 = \begin{bmatrix} \Delta y \\ \Delta y_{ab} \\ \Delta y' \\ \Delta y'_{ab} \\ v_y \end{bmatrix}, \begin{bmatrix} \Delta x \\ \Delta x_{ab} \\ \Delta x' \\ \Delta x'_{ab} \\ v_x \end{bmatrix}, \begin{bmatrix} \Delta\theta \\ \Delta\theta_{ab} \\ \Delta\theta' \\ \Delta\theta'_{ab} \\ v_\theta \end{bmatrix}, \begin{bmatrix} \Delta\xi \\ \Delta\xi_{ab} \\ \Delta\xi' \\ \Delta\xi'_{ab} \\ v_\xi \end{bmatrix} \text{ or } \begin{bmatrix} \Delta\psi \\ \Delta\psi_{ab} \\ \Delta\psi' \\ \Delta\psi'_{ab} \\ v_\psi \end{bmatrix}$$

-continued $$A_5 = \begin{bmatrix} 0 & 0 & 1 & 0 & 0 \\ 0 & 0 & 0 & 1 & 0 \\ a_{21} & 0 & a_{22} & 0 & a_{21} \\ a_{21} & 0 & a_{22} & 0 & a_{21} \\ 0 & 0 & 0 & 0 & 0 \end{bmatrix}$$

$$b_5 = \begin{bmatrix} 0 \\ 0 \\ 0 \\ 0 \\ b_{31} \end{bmatrix}, d_5 = \begin{bmatrix} 0 \\ 0 \\ d_{21} \\ d_{21} \\ 0 \end{bmatrix}, p_5 = \begin{bmatrix} 0 \\ 0 \\ -1 \\ 0 \\ 0 \end{bmatrix}$$

$$u_5 = U_y,\ U_x,\ T_\theta,\ T_\xi \text{ or } T_\psi$$

The term h5 representing irregularities on the guide rails 2 and 2' against the reference optical paths 7*a* and 7*b* is defined by the following formula 34, where the following formula 33 is provided.

Formula 33 is as follows:

$$h_y = y_{ab} - y, h_x = x_{ab} - x, h_\theta = \theta_{ab} - \theta$$

$$h_{\xi - \xi ab} - \xi, h_\psi = \psi_{ab} - \psi$$

Formula 34 is as follows:

$$h_5 = h''_y, h''_x, h''_{\theta,\ h''\xi} \text{ or } h''_\psi$$

Further, $v_5$ is a velocity input to the linear pulse motor for stabilizing the motion in each mode.

Formula 35 is as follows:

$$v_5 = v_y, v_x, v_\theta, v_\xi \text{ or } v_\psi$$

The formula 31 provides guide control by feeding back the following formula 36.

Formula 36 is as follows:

$$v_5 = F_5x_5 + \int K_5x_5dt$$

Where proportional gains are represented by $F_a$, $F_b$, $F_c$, $F_d$ and $F_e$ and an integral gain is represented by $K_e$, $F_5$ and $K_5$ are expressed by the following formula 37.

Formula 37 is as follows:

$$F_5 = [F_aF_bF_cF_dF_e]$$

$$K_5 = [0K_e000]$$

As shown in FIG. 10, the calculator 232 comprises subtractors 241*a*–241*d* and 242*a*–242*h*, a gap deviation coordinate transformation circuit 245, a speed calculator 247, a speed coordinate inverse transformation circuit 248, a vertical position calculator 49, a position deviation coordinate transformation circuit 50, and an irregularity memory circuit 51.

The subtractors 241*a*–241*d* calculate x-direction gap deviation signals $\Delta g_{xa}$–$\Delta g_{xd}$ by subtracting the respective reference values $x_{a0}$–$x_{d0}$ from gap signals $g_{xa}$–$g_{xd}$ from the potentiometers 129*a*–129*d* constituting x-direction gap sensors. The subtractors 242*a*–242*h* calculate y-direction gap deviation signals $\Delta g_{ya1}$, $\Delta g_{ya2}$–$\Delta g_{yd1}$, $\Delta g_{yd2}$ by subtracting the respective reference values $y_{a01}$, $y_{a02}$–$y_{d01,\ yd02}$ from gap signals $g_{ya1}$, $g_{ya2}$,–$g_{yd1}$, $g_{yd2}$ from the potentiometer 127*a*, 128*a*–127*d*, 128*d* constituting y-direction gap sensors.

The gap deviation coordinate transformation circuit 245 calculates y-direction variation Δy of the center of the movable unit 4 on the basis of the y-direction gap deviation signals $\Delta g_{ya1}$, $\Delta g_{ya2}-\Delta g_{yd1}$, $\Delta g_{yd2}$, x-direction variation $\Delta x$ of the center of the movable unit 4 on the basis of the x-direction gap deviation signals $\Delta g_{xa}-\Delta g_{xd}$, a rotation angle $\Delta\theta$ in the $\theta$-direction(rolling direction) of the center of the movable unit 4, a rotation angle $\Delta\xi$ in the $\xi$-direction (pitching direction) of the movable unit 4, and a rotation angle $\Delta\psi$ in the $\psi$-direction(yawing direction) of the movable unit 4, by the use of the formula 29.

The vertical position calculator 49 calculates a vertical position of the movable unit 4 on the basis of the outputs of the two-dimensional photodiode 8*b* and the one-dimensional photodiode 8*c* disposed at the same level. The position deviation coordinate transformation circuit 50 calculates deviation positions $\Delta y_{ab}$, $\Delta x_{ab}$, $\Delta\theta_{ab}$, $\Delta\xi_{ab}$ and $\Delta\psi_{ab}$ of the movable unit 4 in every mode about the reference coordinates on the basis of the outputs of the two-dimensional photodiodes 8*a* and 8*b*, and outputs the calculated results to the speed controller 247. The irregularity memory circuit 51 subtracts an output of the gap deviation coordinate transformation circuit 245 from a position of the movable unit 4 measured by the vertical position calculator 49 and an output of the position deviation coordinate transformation circuit 50, and then consecutively stores irregularity data $h_y$, $h_x$, $h_\theta$, $h_\xi$ and $h_\psi$ of the guide rail 2(2') to the optical path 7*a* (7*b* ) which are transformed into a position of the movable unit 4. The irregularity memory circuit 51 timely reads vertical position data and the irregularity data corresponding to a vertical position of the movable unit 4 and outputs them to the speed calculator 247.

The speed calculator 247 calculates each speed command $v_y$, $v_x$, $v_{\theta,}$ $_{v\xi}$ and $v_\psi$ of the moving elements 134–136 in the respective modes for guiding the movable unit 4 in each y, x, $\theta$, $\xi$ and $\psi$ mode on the basis of outputs $\Delta y$, $\Delta x$, $\Delta\theta$, $\Delta\xi$ and $\Delta\psi$ of the gap deviation coordinate transformation circuit 245. The speed coordinate inverse transformation circuit 248 calculates each moving speed $v_{a1}$,$v_{a2}$, $v_{a3}-v_{a1}$, $v_{a2}$,$v_{a3}$ of the moving elements 134–136 of the suspension units 114*a*, 115*a*, 116*a*–114*d*, 115*d*, 116*d* on the basis of outputs $v_y$, $v_x$, $v_\theta$, $v_\xi$ and $v_{104}$ of the speed calculator 247 by using the formula 30, and feeds back the calculated results to the pulse motor drivers 211*a*, 212*a*, 213*a*–211*d*, 212*d*, 213*d*.

The speed calculator 247 comprises a back and forth mode calculator 247*a*, a right and left mode calculator 247*b*, a roll mode calculator 247*c*, a pitch mode calculator 247*d*, and a yaw mode calculator 247*e*.

The back and forth mode calculator 247*a* calculates a moving speed $v_y$ in the y-mode on the basis of the formula 36 by using inputs $\Delta y$ and $\Delta y_{ab}$. The right and left mode calculator 247*b* calculates a moving speed $v_x$ in the x-mode on the basis of the formula 36 by using inputs $\Delta x$ and $\Delta x_{ab}$. The roll mode calculator 247*c* calculates a moving speed $v_\theta$in the $\theta$-mode on the basis of the formula 36 by using inputs $\Delta\theta$ and $\Delta\theta_{ab}$. The pitch mode calculator 247*d* calculates a moving speed $v_\xi$in the $\xi$-mode on the basis of the formula 36 by using inputs $\Delta\xi$ and $\Delta\xi_{ab}$. The yaw mode calculator 247*e* calculates a moving speed $v_\psi$ in the $\psi$-mode on the basis of the formula 36 by using inputs $\Delta\psi$ and $\Delta\psi_{ab}$.

Figure 11:
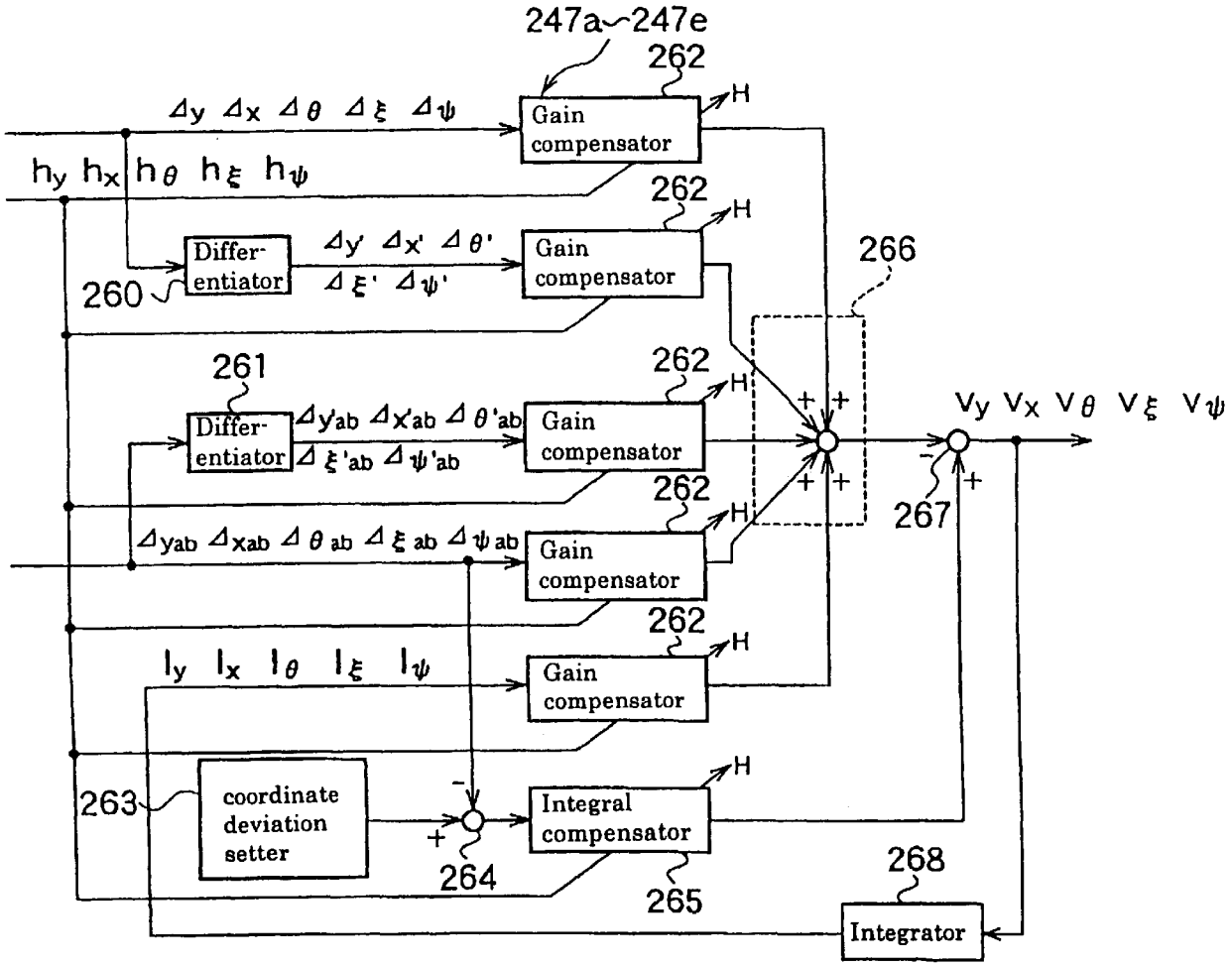
FIG. 11 is a block diagram showing a circuit of a speed calculator of the controller of the second embodiment.

FIG. 11 shows in detail each of the calculators 247*a*–247*e*.

Each of the calculators 247*a*–247*e* comprises a differentiator 260 calculating time change rate $\Delta y'$, $\Delta x'$, $\Delta\theta'$, $\Delta\xi'$ or $\Delta\psi'$ on the basis of each of the gap variations $\Delta y$, $\Delta x$, $\Delta\theta$, $\Delta\xi$ and $\Delta\psi$, a differentiator 261 calculating time change rate $\Delta y'_{ab}$, $\Delta x'_{ab}$, $\Delta\theta'_{ab}$, $\Delta\xi'_{ab}$ or $\Delta\psi'_{ab}$ on the basis of each of the variation $\Delta y_{ab}$, $\Delta x_{ab}$, $\Delta\theta_{ab}$, $\Delta\xi_{ab}$ and $\Delta\psi_{ab}$ from the reference position, and an integrator 268 integrating each moving speed $v_y$, $v_x$, $v_\theta$, $v_\xi$ and $v_\psi$ in the respective modes and outputting moving distances $l_y$, $l_x$, $l_\theta$, $l_\xi$ and $l_\psi$, gain compensators 262 multiplying each of the variations $\Delta y-\Delta\psi$ and $\Delta y_{ab}-\Delta\psi_{ab}$, each of the time change rates $\Delta y'-\Delta\psi'$ and $\Delta y'_{ab}-\Delta\psi'_{ab}$ and each of the moving distances $l_y-l_\psi$, by an appropriate feedback gain respectively. Each of the calculators 247*a*–247*e* also comprises a coordinate deviation setter 263, a subtractor 264 subtracting each of the variation $\Delta y_{ab}-\Delta\psi_{ab}$ from a reference value output by the coordinate deviation setter 263, an integral compensator 265 integrating the output of the subtractor 264 and multiplying the integrated result by an appropriate feed back gain, an adder 266 calculating the sum of the outputs of the gain compensators 262, and a subtractor 267 subtracting the output of the adder 266 from the output of the integral compensator 265, and outputting the moving speeds $v_y$, $v_x$, $v_\theta$, $v_\xi$ and $v_\psi$, of the respective y, x, $\theta$, $\xi$ and $\psi$ modes. The gain compensator 262 and the integral compensator 265 may change a set gain on the basis of vertical position data H and the irregularity data $h_y$, $h_x$, $h_\theta$, $h_\xi$ and $h_\psi$ corresponding to a vertical position of the movable unit 4.

The following explains an operation of the above-described guide system of the second embodiment of the present invention.

In case the movable unit 4, which is guided with the guide units 100*a*–100*d*, starts to move upwardly by a hoisting machine(not shown) and passes relatively gentle irregularities such as warps, a shake of the movable unit 4 caused by irregularities on the guide rails 2 and 2' may be restrained effectively, since the controller 230 feeds back each of the variations $\Delta y_{ab}-\Delta\xi_{ab}$, and each of the time change rates $\Delta y'_{ab}-\Delta\psi'_{ab}$ to each of the moving speed $v_y$, $v_x$, $v_\theta$, $v_\xi$ and $v_\psi$ via the gain compensator 262.

Likewise the first embodiment, since the irregularity data $h_y$, $h_x$, $h_\theta$, $h_\xi$ and $h_\psi$ and the vertical position data H are read out by the irregularity memory circuit 51, and the gain compensator 262 and the integral compensator 265 input these data, the gain compensator 262 and the integral compensator 265 may change controlling parameters at intervals having irregularities.

Even if a difference in level or a gap caused by a repetition of thermal expansion and contraction or an earthquake occur at a joint of the guide rail 2(2'), a shake of the movable unit 4 may be restrained to a minimum by changing controlling parameters so that guiding forces of the guide units 100*a*–100*d* possess an extremely low spring constant.

Figure 12B:
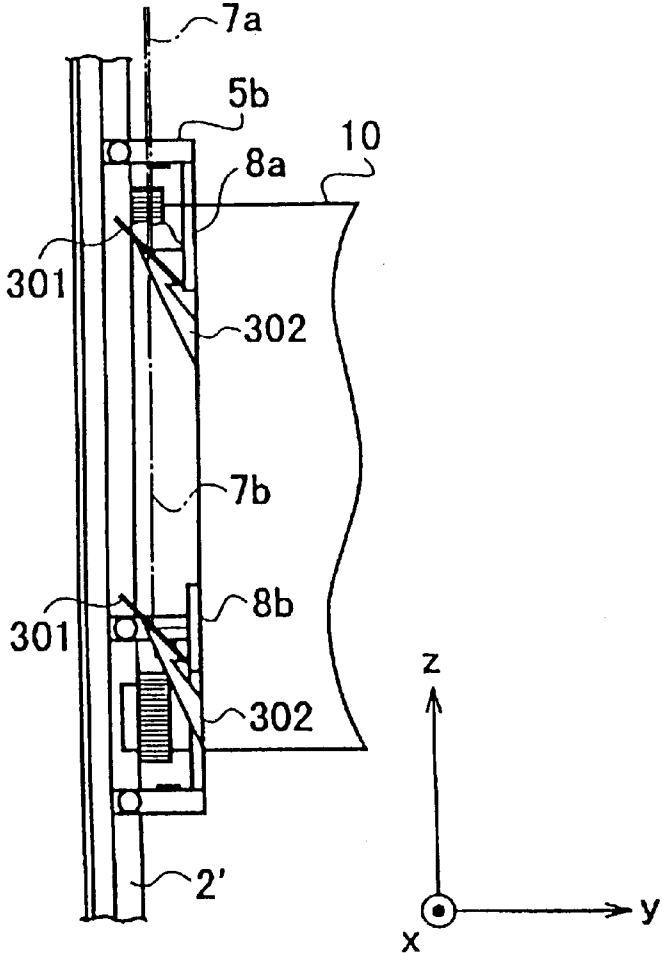
FIG. 12(*a*) is a side view showing a position detector of a third embodiment.
Figure 12A:
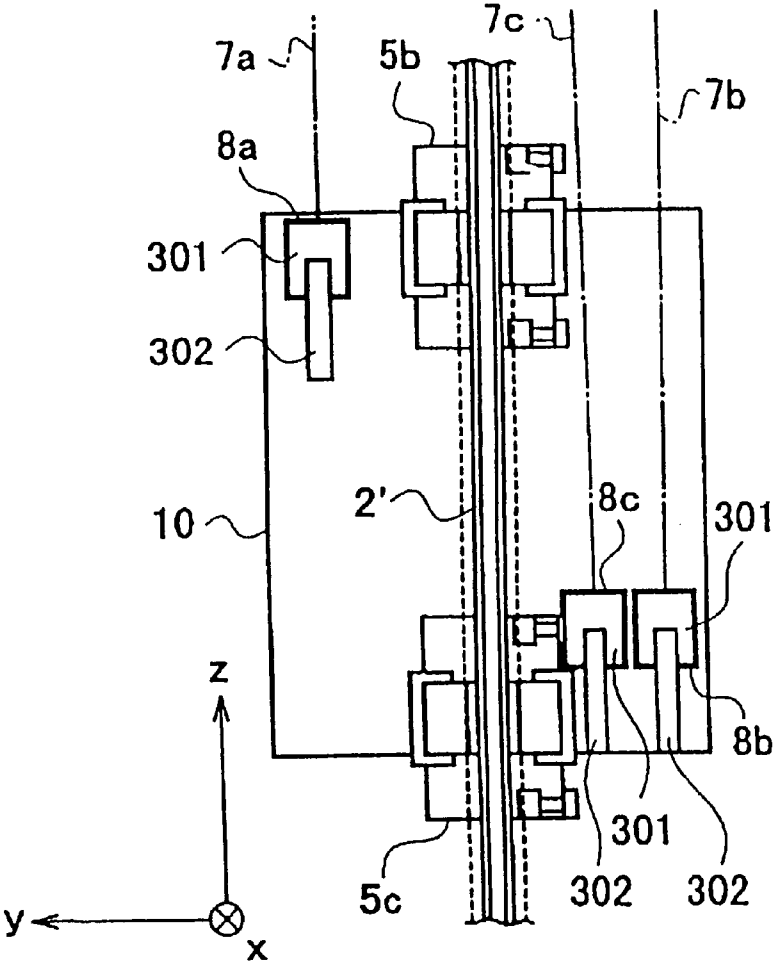

The following is an explanation of a guide system of a third embodiment of the present invention. According to the first and second embodiments, the photodiodes 8*a*–8*c* directly receive lasers radiated by the laser radiators 6*a*–6*c* as shown FIG. 1. However, the optical paths 7*a*–7*c* are not limited to the above, and other constructions shown in FIG. 12 may be adopted. That is, the elevator cage 10 includes supports 302 fixing mirrors 301 facing the cage 10 at a 45 degree angle, and includes the photodiodes 8*a*–8*c* on the side surface thereof, whereby the optical paths 7*a*–7*c* made a right-angled turn reach to the photodiodes 8*a*–8*c*.

According to the third embodiment, since the surfaces of the photodiodes 8*a*–8*c* are disposed at a right angle, the surfaces are hardly covered with dust, thereby enabling a long term use without cleaning.

Figure 13B:
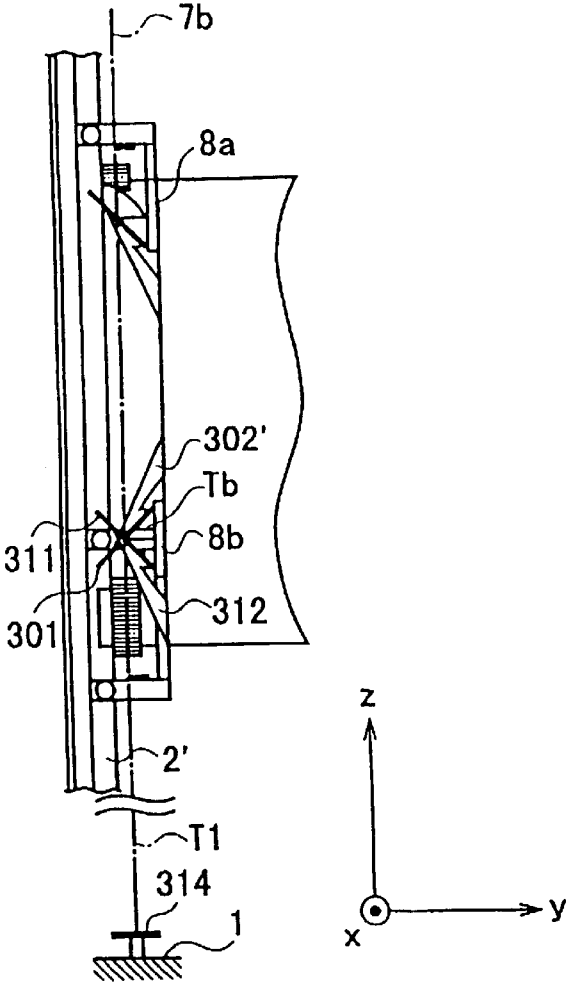
FIG. 13(*a*) is a side view showing a position detector of a fourth embodiment.
Figure 13A:
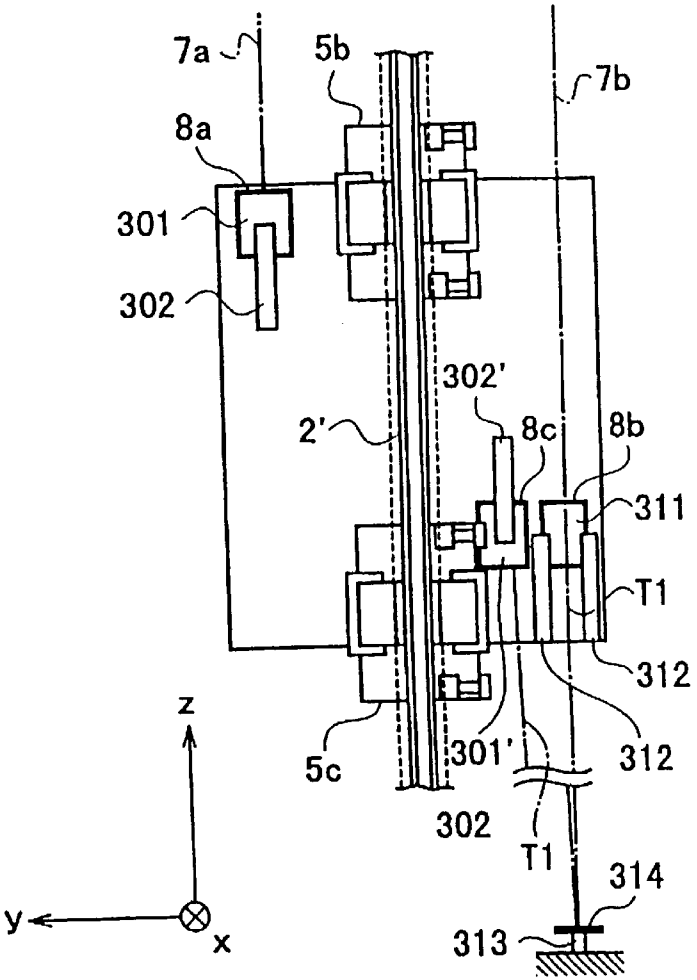

In the first, second and third embodiments, three laser radiators are used for forming three optical paths 7*a*–7*c*. However, the number of the laser radiators are not limited to the above system, one optical path 7*b* may be divided into two optical paths by attaching a half mirror 311 fixed with two supports 312 as shown in FIG. 13.

In this case, the half mirror 311 on the optical path 7*b* generates a transmitted light T1 and a reflected light Tb perpendicular to the transmitted light T1. The transmitted light T1 is incident on a mirror 314 slightly tilted and disposedt on the bottom of the hoistway 1 through a base 313. The reflected light Tb is incident on the photodiode 8*b*.

An optical axis of the transmitted light T1 is reflected in a slightly inclining direction on the y and z coordinate plane and incident on the photodiode 8*c* by being reflected by a mirror 301' facing downward fixed on the side of the elevator cage 10 through a support 302' at a position adjacent to the half mirror 311.

According to the above optical system, the same guide control as the first and second embodiments may be achieved. Further, since relatively expensive laser radiators are reduced from three to two, an elevator system cost may be reduced.

Figure 14:
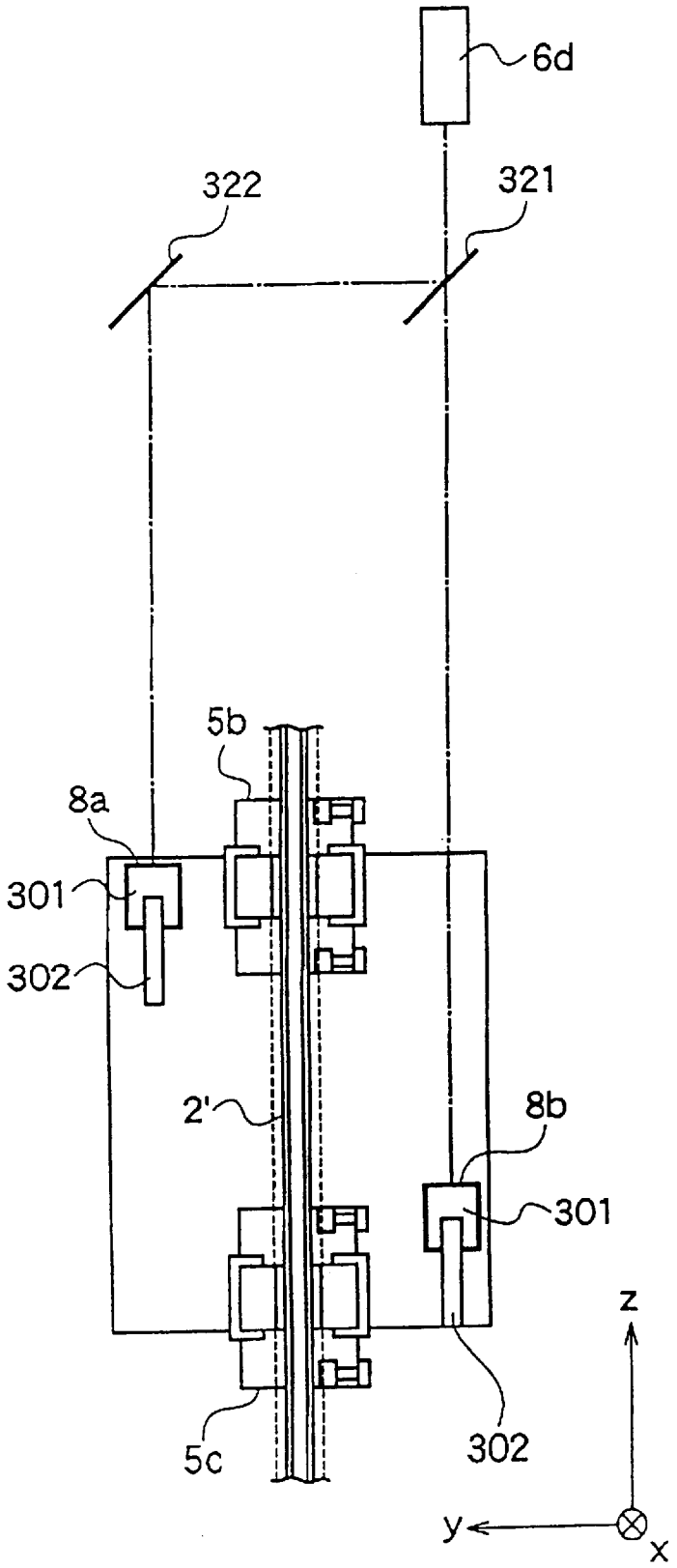
FIG. 14 is a side view showing a position detector of a fifth embodiment.

Moreover, as shown in FIG. 14, an optical path created by only one laser radiator 6*d* may be divided into two with a half mirror 321 and a mirror 322. In this case, since the photodiode 8*c* is eliminated and the only photodiodes 8*a* and 8*b* are used, a vertical position of the movable unit 4 is not detected. The number of optical paths may be voluntarily selected as desired.

Further, in the above embodiments, although laser oscillating tubes are respectively adopted as the laser radiators 6*a*, 6*b* and 6*c*, laser emitting semiconductor devices may be substituted for the laser oscillating tubes. Furthermore, the controllers 30 and 230 may be constituted of either an analog circuit or a digital circuit.

According to the present invention, since a position correction against a shake of a movable unit is executed on the basis of a gap between an optical path forming a reference position and the movable unit, and when the movable unit passes a position corresponding to an irregularity on a guide rail which is stored in advance during the initial running, an antiphase force is operated on the guide rail against the irregularity or the shake of the movable unit, the shake may be restrained, thereby improving a comfortable ride.

Further, since a plurality of optical paths is formed, a position correction against a shake of a movable unit may be executed by detecting gaps around a plurality of axes, for example, a horizontal axis and a vertical axis.

Furthermore, since a hoistway is a dark place, even a relatively low power laser radiator may create a reference optical path, thereby dispensing with a cooler system and enabling to form a reference optical path at a low cost.

Moreover, since an optical path is slightly inclined against a vertical line and a one-dimensional photodiode is disposed on the optical path, a vertical position of the movable unit may be detected on the basis of the incident position of a coherent light on the photodiode, especially a position corresponding to an irregularity on a guide rail may be detected during an initial running.

Further, since a two-dimensional photodiode is disposed on a vertical optical path, a gap position of the movable unit may be detected on the basis of the incident position of a coherent light on the photodiode. Since two two-dimensional photodiodes are disposed at the different levels and disposed on a respective vertical optical paths, three-dimensional position of the movable unit may be detected and corrected on the basis of the incident positions of the coherent lights on the photodiodes.

Furthermore, a magnetic levitation force generated from electromagnets is used for a guide system, the movable unit may be guided with no contact with guide rails, thereby realizing a comfortable ride.

Moreover, a mirror or a half mirror is equipped for changing a direction of an optical path, the number of laser radiators may become fewer than the number of optical paths, thereby reducing cost.

Further, since a vertical position of the movable unit is detected by using two optical paths that are not parallel to one another, a vertical position of the movable unit may be detected accurately with no contact.

Various modifications and variations are possible in light of the above teachings. Therefore, it is to be understood that within the scope of the appended claims, the present invention may be practiced otherwise than as specifically described herein.

What is claimed is:

1. A guide system for an elevator, comprising:

a movable unit configured to move along a guide rail;

a beam projector configured to form a plurality of optical paths of light in a plane parallel to a moving direction of said movable unit, wherein at least two of said plurality of optical paths are not parallel to each other;

position detectors disposed on said optical paths and configured to detect a position relationship between said optical path and said movable unit; and an actuator coupled to said movable unit and configured to change a position of aid movable unit by a reaction force caused by a force operating on said guide rail on the basis of an output of said position detector.

2. The guide system as recited in claim 1, wherein:

said position detector detects a vertical position of said movable unit by said at least two of said plurality of optical paths that are not parallel to each other.

3. The guide system as recited in claim 1, wherein said beam projector comprises a laser radiator.

4. The guide system as recited in claim 3, wherein said laser radiator comprises a laser oscillating tube.

5. The guide system as recited in claim 3, wherein said laser radiator comprises a laser emitting semiconductor device.

6. The guide system as recited in claim 1, wherein said position detector comprises an one-dimensional photodiode.

7. The guide system as recited in claim 1, wherein said position detector comprises a two-dimensional photodiode.

8. The guide system as recited in claim 1, wherein said actuator comprises, a magnet unit including an electromagnet facing said guide rail and having a gap, a sensor configured to detect a condition of a magnetic circuit formed with said electromagnet, said gap and said guide rail, and a guide controller configured to control an exciting current t o said electromagnet in response to outputs of said is sensor and said position detector to stabilize said magnetic circuit.

9. The guide system as recited in claim 8, wherein said sensor comprises a second position detector configured to detect a position relationship between said guide rail and said magnet unit on a horizontal plane.

10. The guide system as recited in claim 8, wherein said sensor comprises a current detector configured to detect an exciting current of said electromagnet.

11. The guide system as recited in claim 8, wherein said magnet unit comprises a permanent magnet providing a magnetomotive force for guiding said movable unit, and disposed to form a common magnetic circuit with said electromagnet at said gap.

12. The guide system as recited in claim 8, wherein said guide controller controls to stabilize said magnetic circuit on the basis of the outputs of said sensor and said second position detector so that said exciting current converges zero at a steady state.

13. The guide system as recited in claim 1, wherein said position detector further comprises a mirror.

14. The guide system as recited in claim 1, wherein said position detector further comprises a half mirror.

15. A guide system for controlling movement of an elevator car along a guide rail, the guide system comprising:

a beam projector positioned to form light beams in a plurality of respective optical paths in a plane substantially parallel to the elevator car, wherein at least two of said plurality of optical paths are not parallel to each other;

position detectors disposable on the elevator car to receive said light beams and configured to provide an output signal indicative of the position of the elevator car relative to the optical paths, and to detect a vertical position of said elevator car based on said at least two optical paths that are not parallel to each other; and an actuator attachable to the elevator car to urge the elevator car to a different position in response to a force operating on the guide rail and the output signal indicative of the position of the elevator car.

* * * * *